US012590438B2

(12) United States Patent
Poirier et al.

(10) Patent No.: US 12,590,438 B2
(45) Date of Patent: Mar. 31, 2026

(54) IMPLEMENT CONNECTION SYSTEM AND VEHICLE HAVING SAME

(71) Applicant: BOMBARDIER RECREATIONAL PRODUCTS INC., Valcourt (CA)

(72) Inventors: Kevin Poirier, Racine (CA); Charles Roy, Orford (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 841 days.

(21) Appl. No.: 17/682,684

(22) Filed: Feb. 28, 2022

(65) Prior Publication Data

US 2022/0275603 A1 Sep. 1, 2022

Related U.S. Application Data

(60) Provisional application No. 63/154,551, filed on Feb. 26, 2021.

(51) Int. Cl.
*E01H 5/06* (2006.01)
*E02F 3/76* (2006.01)

(52) U.S. Cl.
CPC ..... *E02F 3/7622* (2013.01); *E01H 5/061* (2013.01)

(58) Field of Classification Search
CPC ..... E02F 3/7622; E02F 9/2833; E01H 5/061; F16B 39/08; F16B 7/042; F16B 7/044; F16B 7/0486; F16B 7/1427; F16B 7/16; F16B 7/004; F16B 7/006; F16B 9/02; F16B 9/058; F16B 19/02; F16B 19/05; F16B 21/00; F16B 21/02; F16B 21/07; F16B 21/071–078; F16D 55/227; F16D 65/095; B62K 27/006; B60D 1/483; B60D 1/485
See application file for complete search history.

(56) References Cited

U.S. PATENT DOCUMENTS 6,443,344 B1 * 9/2002 Nicosia ..... B62J 7/04 292/341.15
6,481,735 B1 * 11/2002 Hilk ..... B62K 27/006 280/503

(Continued)

FOREIGN PATENT DOCUMENTS

CA 2580423 A1 7/2008

OTHER PUBLICATIONS

McMaster-Carr, Catalog-Clevis Pins, retrieved from https://www.mcmaster.com/products/pins/clevis-pins-2~/ on Feb. 23, 2024.

(Continued)

*Primary Examiner* — Joseph M Rocca
*Assistant Examiner* — Robert E Pezzuto
(74) *Attorney, Agent, or Firm* — BCF LLP

(57) ABSTRACT

An implement connection system for connecting an implement to a vehicle. The implement connection system includes a pin having a distal portion defining a distal end of the pin and a proximal portion defining a proximal end of the pin. The distal portion is adapted to be received by an implement connector. The implement connection system also includes a fastener extending into the pin for removably fastening the pin to a portion of the vehicle. The proximal end is disposed between the distal end and the portion of the vehicle when the pin is fastened to the portion of the vehicle.

19 Claims, 27 Drawing Sheets

(56) References Cited

U.S. PATENT DOCUMENTS

| | | | | |
|---|---|---|---|---|
| 7,520,523 | B1 * | 4/2009 | Dighans | B62J 25/06 280/288.4 |
| 7,818,903 | B2 * | 10/2010 | Elliot | A01B 59/064 37/468 |
| 8,381,422 | B2 * | 2/2013 | Hill | E02F 3/848 37/231 |
| 8,769,847 | B2 | 7/2014 | Coulombe et al. | |
| 2008/0104865 | A1 * | 5/2008 | Bailey | E01H 5/06 37/231 |
| 2019/0351930 | A1 * | 11/2019 | Kinnunen | B62B 5/0086 |

OTHER PUBLICATIONS

Office Action issued from the Canadian Intellectual Property Office on Feb. 20, 2024 in connection with the corresponding application No. 3,150,387.

* cited by examiner

IMPLEMENT CONNECTION SYSTEM AND VEHICLE HAVING SAME

CROSS-REFERENCE

The present application claims priority from U.S. Provisional Patent Application No. 63/154,551, filed Feb. 26, 2021, the entirety of which is incorporated by reference herein.

FIELD OF THE TECHNOLOGY

The present technology relates to an implement connection system for a vehicle, and in particular a plow connection system.

BACKGROUND

All-terrain vehicles (ATVs) and similar vehicles are used for utility and recreational purposes. Some ATVs are configured to be equipped with an implement such as a plow, a snow blower, or other types of implements which enables the ATV to be used for performing a particular task with that implement. For example, when the ATV is equipped with a plow, the driver of the ATV can use the plow to handle material (e.g., dirt, snow, etc.) therewith.

In order to enable the ATV to be equipped with such an implement, a frame of the ATV is often modified to incorporate mounting brackets on an underside of a front portion thereof which can be used to mount the implement. These mounting brackets remain attached to the ATV even when the implement is not equipped. However, such mounting brackets are typically heavy and cumbersome, thus increasing the weight of the ATV, and moreover are costly to manufacture and install. Furthermore, damage sustained to a left or right one of the mounting brackets sometimes requires replacement of both mounting brackets since they are typically made as a single integral implement mount.

Thus, there is a desire for an implement connection system for an ATV or other such vehicles that addresses some of the aforementioned drawbacks.

SUMMARY

It is an object of the present technology to ameliorate at least some of the inconveniences present in the prior art.

According to an aspect of the present technology, there is provided an implement connection system for connecting an implement to a vehicle. The implement connection system includes a pin having a distal portion defining a distal end of the pin and a proximal portion defining a proximal end of the pin. The distal portion is adapted to be received by an implement connector. The implement connection system also includes a fastener extending into the pin for removably fastening the pin to a portion of the vehicle. The proximal end is disposed between the distal end and the portion of the vehicle when the pin is fastened to the portion of the vehicle.

In some embodiments, the proximal portion of the pin is a non-cylindrical portion.

In some embodiments, the non-cylindrical portion tapers toward the proximal end.

In some embodiments, the non-cylindrical portion has a generally triangular shape.

In some embodiments, the non-cylindrical portion includes a plurality of planar peripheral surfaces and a plurality of vertices disposed between the planar peripheral surfaces. The planar peripheral surfaces are angled relative to one another.

In some embodiments, the planar peripheral surfaces include at least three planar peripheral surfaces. The at least three planar peripheral surfaces are disposed equiangularly relative to one another.

In some embodiments, the non-cylindrical portion has a generally asymmetric shape.

In some embodiments, the non-cylindrical portion has a transverse surface that is normal to a central axis of the pin. The non-cylindrical portion defines a pin orientation feature for orienting the pin on the portion of the vehicle. The pin orientation feature is one of a recess defined in the transverse surface and a protrusion extending from the transverse surface.

In some embodiments, the fastener extends along a fastener axis which is coaxial with a central axis of the pin.

In some embodiments, the non-cylindrical portion of the pin is adapted to be inserted in a non-cylindrical recess of a frame of the vehicle. The non-cylindrical recess being complementary in shape to the non-cylindrical portion of the pin.

In some embodiments, the implement connection system also includes an adapter receiving the non-cylindrical portion of the pin. The adapter is configured to be connected to a frame of the vehicle.

In some embodiments, the adapter includes a plurality of inner surfaces defining a recess having a shape corresponding to a shape of the non-cylindrical portion of the pin. The inner surfaces of the adapter are configured to mate with the non-cylindrical portion of the pin.

In some embodiments, the adapter defines a threaded opening. The fastener engages the threaded opening of the adapter to connect the pin to the vehicle.

In some embodiments, the recess has a recess bottom and the recess tapers toward the recess bottom.

In some embodiments, the distal portion of the pin is a cylindrical portion.

In some embodiments, the distal portion of the pin is a cylindrical portion. A circle circumscribing the non-cylindrical portion and extending through the vertices of the non-cylindrical portion has a diameter that is greater than a diameter of the cylindrical portion.

In some embodiments, the distal end of the pin defines a counterbore receiving a head of the fastener.

In some embodiments, the pin is a first pin, the fastener is a first fastener, and the portion of the vehicle is a first portion of the vehicle. The implement connection system also includes a second pin coaxial with the first pin. The second pin has a distal portion defining a distal end of the second pin and a proximal portion defining a proximal end of the second pin. The distal portion of the second pin is adapted to be received by another implement connector. The implement connection system also includes a second fastener extending into the second pin for removably fastening the second pin to a second portion of the vehicle. The proximal end of the second pin is disposed between the distal end of the second pin and the second portion of the vehicle when the second pin is fastened to the second portion of the vehicle.

In some embodiments, the implement connection system is a plow connection system for connecting a plow to the vehicle.

In some embodiments, a plow assembly includes the plow connection system and a plow connected to the plow connection system, the plow comprising: first and second support arms; and first and second implement connectors connected to the first and second support arms respectively, the first and second implement connectors being supported by the distal portion of the first pin and the distal portion of the second pin respectively.

In some embodiments, each of the first and second implement connectors has a hooked end engaging the distal portion of a corresponding one of the first and second pins.

In some embodiments, the plow further comprises first and second bumpers for limiting movement of the first and second pins relative to the plow and to prevent damage to the first and second pins; and the first and second bumpers are connected to the first and second support arms respectively and positioned to abut the first and second pins in response to the first and second pins moving forward relative to the plow.

In some embodiments, the first and second bumpers are made of a polymeric material.

In some embodiments, the non-cylindrical portion has a generally truncated conical shape.

In some embodiments, a maximum diameter of the truncated conical shape of the non-cylindrical portion is greater than a diameter of the distal portion.

In some embodiments, the non-cylindrical portion has a transverse surface that is normal to a central axis of the pin; and the non-cylindrical portion defines a movement limiting feature for at least partly limiting movement of the pin relative to the portion of the vehicle, the movement limiting feature being one of: a recess defined in the transverse surface; and a protrusion extending from the transverse surface.

In some embodiments, the fastener extends along a fastener axis, the fastener axis extending at an angle relative to a central axis of the pin.

In some embodiments, the fastener is a first fastener extending along a first fastener axis; the implement connection system further comprises a second fastener extending into the pin for removably fastening the pin to the portion of the vehicle; and the second fastener extends along a second fastener axis, the second fastener axis extending at an angle to the first fastener axis and the central axis of the pin.

In some embodiments, the first fastener and the second fastener extend into the non-cylindrical portion of the pin.

In some embodiments, the implement connection system further comprises an adapter receiving the non-cylindrical portion of the pin, the adapter being configured to be connected to a frame of the vehicle, wherein: the adapter comprises: a plurality of inner surfaces defining a recess having a shape corresponding to a shape of the non-cylindrical portion of the pin, the inner surfaces of the adapter being configured to mate with the non-cylindrical portion of the pin; and a protrusion extending from one of the inner surfaces of the adapter and into the non-cylindrical portion of the pin to limit movement of the pin relative to the adapter.

In some embodiments, the protrusion is aligned with a central axis of the pin.

In some embodiments, the distal portion of the pin is configured to fail under mechanical stress to protect the portion of the vehicle.

In some embodiments, the distal portion of the pin is generally cylindrical and has a central opening extending along a majority of a length of the distal portion.

According to another aspect of the present technology, there is provided a kit for connecting an implement to a vehicle. The kit includes a pin having a distal portion defining a distal end of the pin and a proximal portion defining a proximal end of the pin. The distal portion is adapted to be received by an implement connector. The kit also includes an adapter for receiving the proximal portion of the pin. The adapter is configured to be connected to a portion of the vehicle. The kit also includes a fastener configured to extend into the pin and the adapter for removably fastening the pin to the portion of the vehicle. The proximal end is disposed between the distal end and the portion of the vehicle when the pin is fastened to the portion of the vehicle.

In some embodiments, the proximal portion of the pin is a non-cylindrical portion.

In some embodiments, the distal portion of the pin is a cylindrical portion.

According to another aspect of the present technology, there is provided a vehicle including: a frame; a motor supported by the frame; and at least one ground-engaging member operatively connected to the motor for propelling the vehicle. The vehicle also includes a first pin and a second pin connected to the frame and configured for connection of a plow to the vehicle. The first and second pins are coaxial with one another and are disposed on opposite lateral sides of a longitudinal center plane of the vehicle. Each of the first and second pins has: a distal cylindrical portion defining a distal end of the pin and a proximal non-cylindrical portion defining a proximal end of the pin. The cylindrical portion is adapted to be received by a respective one of left and right implement connectors. The proximal end of the pin is closer to the longitudinal center plane of the vehicle than the distal end of the pin. The vehicle also includes a first fastener and a second fastener extending into respective ones of the first and second pins for removably fastening the first and second pins to the frame of the vehicle.

In some embodiments, the first and second pins are longitudinally aligned with one another.

In some embodiments, the non-cylindrical portion tapers toward the proximal end.

In some embodiments, the non-cylindrical portion has a generally triangular shape.

In some embodiments, the non-cylindrical portion comprises a plurality of planar peripheral surfaces and a plurality of vertices disposed between the planar peripheral surfaces. The planar peripheral surfaces are angled relative to one another.

In some embodiments, a circle circumscribing the non-cylindrical portion and extending through the vertices of the non-cylindrical portion has a diameter that is greater than a diameter of the cylindrical portion.

In some embodiments, the planar peripheral surfaces include at least three planar peripheral surfaces. The at least three planar peripheral surfaces are disposed equiangularly relative to one another.

In some embodiments, the non-cylindrical portion has a generally asymmetric shape.

In some embodiments, the non-cylindrical portion has a transverse surface that is normal to a central axis of the cylindrical portion. The non-cylindrical portion defines a pin orientation feature for orienting the pin on the portion of the vehicle. The pin orientation feature is one of a recess defined in the transverse surface and a protrusion extending from the transverse surface.

In some embodiments, each of the first and second fasteners extends along a fastener axis. The fastener axis is coaxial with a central axis of the cylindrical portion of a corresponding one of the first and second pins.

In some embodiments, the frame defines a first recess and a second recess. Each of the first and second recesses of the frame has a shape corresponding to a shape of the non-cylindrical portion of corresponding ones of the first and second pins. The non-cylindrical portions of the first and second pins are inserted into the first and second recesses of the frame respectively.

In some embodiments, the vehicle also includes a first adapter and a second adapter connected to the frame. Each of the first and second adapters receives the non-cylindrical portion of a corresponding one of the first and second pins.

In some embodiments, the frame defines first and second openings receiving corresponding ones of the first and second fasteners therein.

In some embodiments, each of the first and second adapters includes a plurality of inner surfaces defining a recess having a shape corresponding to a shape of the non-cylindrical portion of the corresponding one of the first and second pins. The inner surfaces of each of the first and second adapters mate with the non-cylindrical portion of the corresponding one of the first and second pins.

In some embodiments, each of the first and second adapters defines a threaded opening. A corresponding one of the first and second fasteners engages the threaded opening of a corresponding one of the first and second adapters to connect the corresponding one of the first and second pins to the frame.

In some embodiments, the recess has a recess bottom and the recess tapers toward the recess bottom.

In some embodiments, the distal end of each of the first and second pins defines a counterbore receiving a head of the first and second fasteners respectively.

According to another aspect of the present technology, there is provided a plow connection system for connecting a plow to the vehicle, the plow connection system comprising: a first pin having: a distal portion defining a distal end of the first pin, the distal portion of the first pin being adapted to be received by a first implement connector; and a proximal portion defining a proximal end of the first pin; a first fastener extending into the pin for removably fastening the first pin to a first portion of the vehicle, the proximal end of the first pin being disposed between the distal end of the first pin and the first portion of the vehicle when the first pin is fastened to the first portion of the vehicle; a second pin coaxial with the first pin, the second pin having: a distal portion defining a distal end of the second pin, the distal portion of the second pin being adapted to be received by another implement connector; and a proximal portion defining a proximal end of the second pin; and a second fastener extending into the second pin for removably fastening the second pin to a second portion of the vehicle, the proximal end of the second pin being disposed between the distal end of the second pin and the second portion of the vehicle when the second pin is fastened to the second portion of the vehicle.

For purposes of the present application, terms related to spatial orientation when referring to a vehicle and components in relation to the vehicle, such as "forwardly", "rearwardly", "left", "right", "above" and "below", are as they would be understood by a driver of the vehicle sitting thereon in an upright driving position, with the vehicle steered straight-ahead.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present technology will be described with reference to a four-wheeled straddle-seat all-terrain vehicle (ATV) 10. However, it is contemplated that aspects of the present technology could be used in other types of off-road vehicles, such as side-by-side vehicles, dune buggies, and the like.

Figure 1:
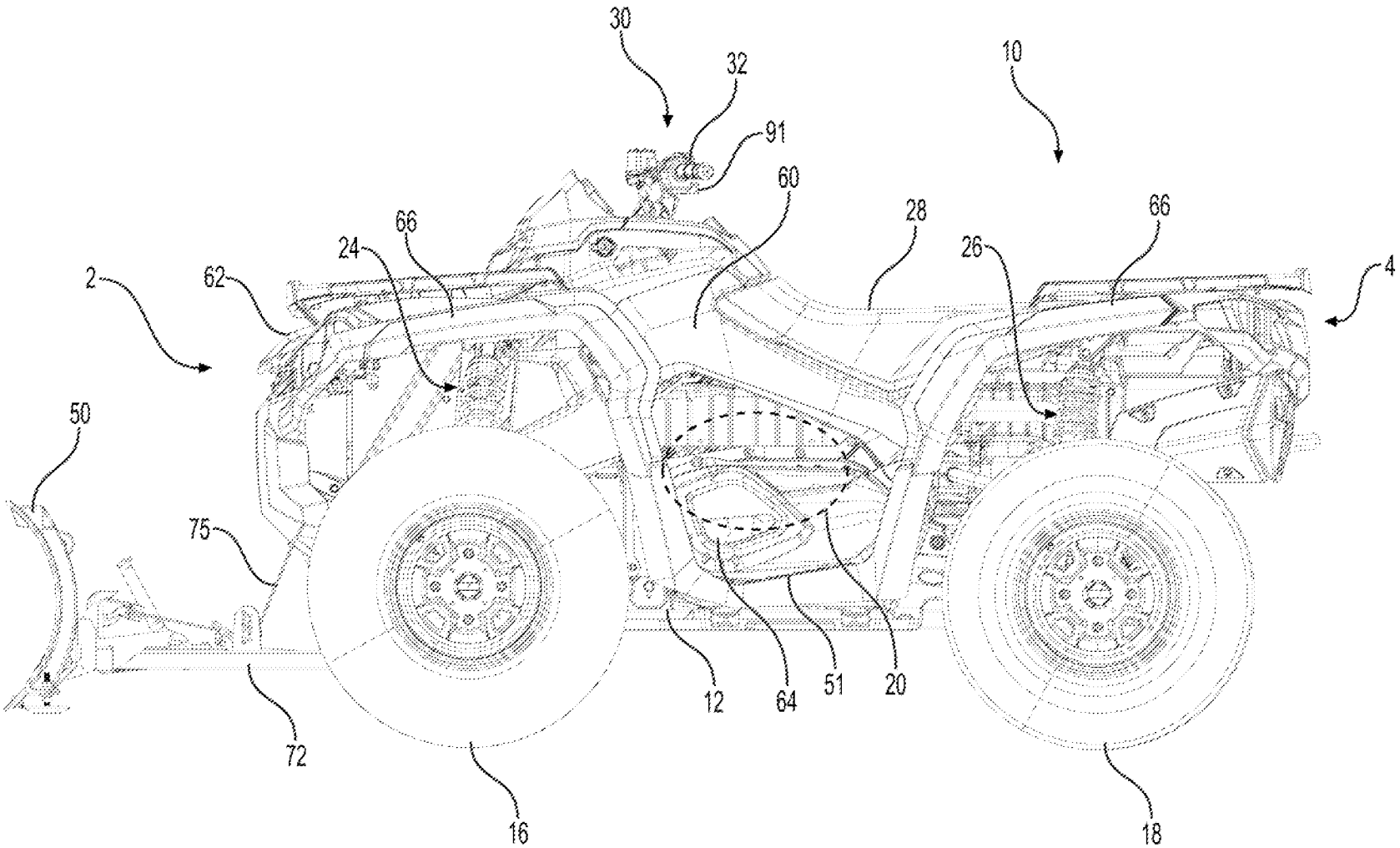
FIG. 1 is a left side elevation view of an all-terrain vehicle (ATV) provided with a plow.
Figure 2:
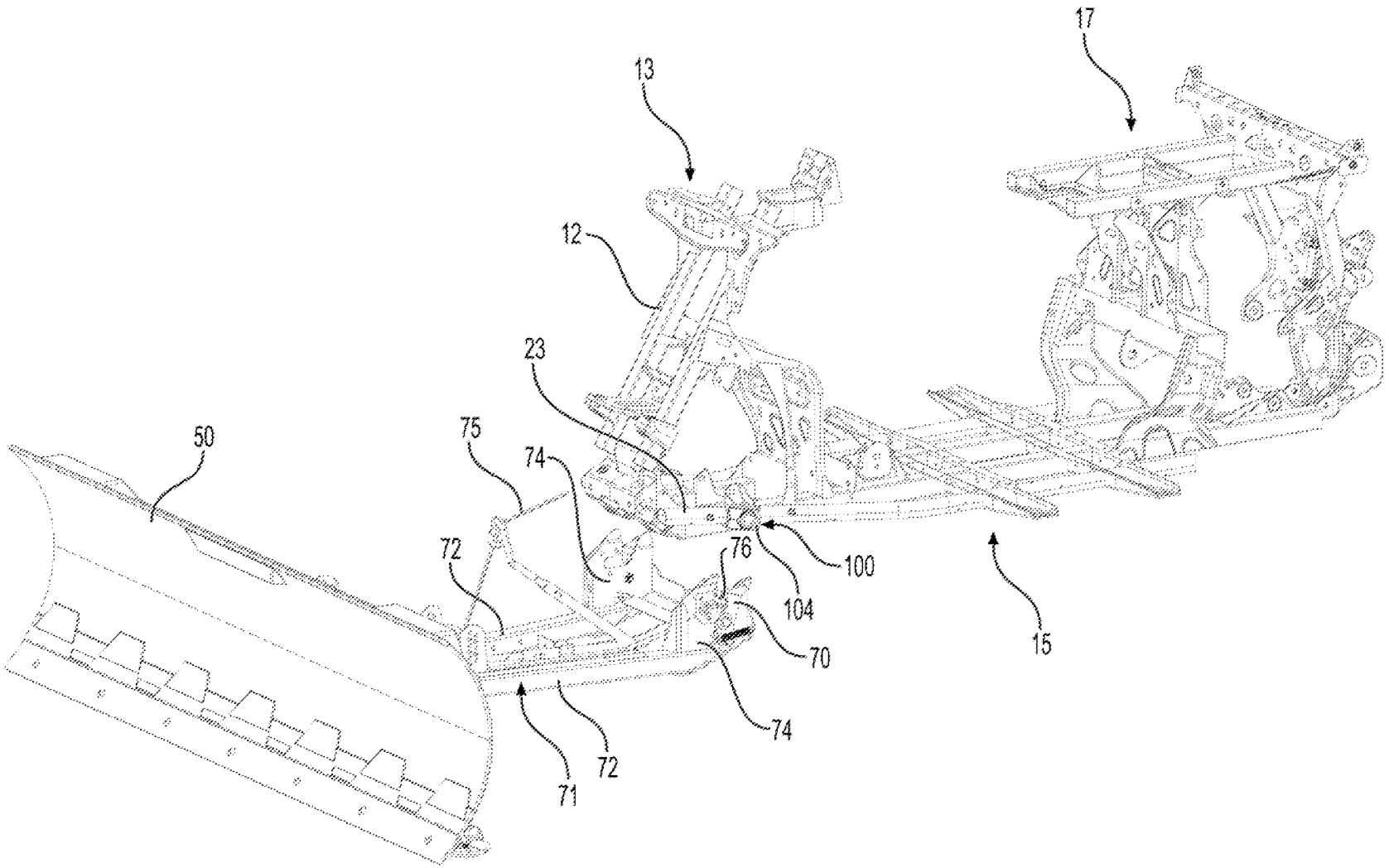
FIG. 2 is a perspective view, taken from a front, left side, of a frame and a left part of a plow connection system of the vehicle of FIG. 1, with a plow shown disconnected from the vehicle.

With reference to FIG. 1, the ATV 10 has a front end 2 and a rear end 4 defined consistently with a forward travel direction of the ATV 10. The ATV 10 has a frame 12 to which a vehicle body is mounted. As shown in FIG. 2, the frame 12 has a front portion 13, a middle portion 15 and a rear portion 17. A pair of front wheels 16 is suspended from the front portion 13 of the frame 12 via front suspension assemblies 24. A pair of rear wheels 18 is suspended from the rear portion 17 of the frame 12 via rear suspension assemblies 26.

The ATV 10 includes an implement 50 which can be selectively installed and uninstalled therefrom. The implement 50 is disposed forwardly of the frame 12. In this embodiment, the implement 50 is a plow for moving material therewith. For instance, the plow 50 can be used to move snow, dirt, or any other material. It is contemplated that, in alternative embodiments, the implement 50 may be any other suitable implement (e.g., a snowblower). As will be described in greater detail below, an implement connection system 100 enables the plow 50 to be connected to the frame 12. A winch (not shown) is fixed to the front portion 13 of the frame 12 and a cable 75 (FIGS. 1 to 3) is wound about the winch and connected to a portion of the plow 50. By actuating the winch, the plow 50 can be selectively lifted or lowered as the angular orientation of the plow 50 is adjusted.

As illustrated in FIG. 1, the ATV 10 also includes fairings 60 including a front fascia 62 at the front end 2 of the ATV 10 and several side panels 64 extending over lateral sides of the ATV 10. A fender 66 is disposed over each wheel well overarching the wheels 16, 18 to protect the driver and/or passenger from dirt, water and other debris being projected by the wheels 16, 18. The ATV 10 further includes a straddle-type driver seat 28 mounted to the frame 12 for accommodating a driver of the ATV 10. Driver footrests 51 are provided on either side of the driver seat 28 and are disposed vertically lower than the driver seat 28 to support the driver's feet. Another straddle-type passenger seat may be provided behind the driver seat 28 to accommodate a passenger.

A steering assembly 30 is rotationally supported by the frame 12 to enable a driver to steer the ATV 10. The steering assembly 30 includes a handlebar assembly including a handlebar 32 connected to a steering column (not shown) for actuating steering linkages operably connected to the left and right front wheels 16. In this embodiment, the steering assembly 30 includes a power steering electric motor mounted to the steering column for facilitating steering. The power steering electric motor is operatively connected to the steering column and to the left and right front wheels 16 via the steering linkages.

As shown in FIG. 1, a throttle operator 91 in the form of a thumb-actuated throttle lever is provided near the right end of the handlebar 32. Other types of throttle operators, such as a finger-actuated throttle lever and a twist grip, are also contemplated. The throttle operator 91 is selectively actuated by the driver of the ATV 10 to request throttle from the engine. More specifically, a throttle operator position sensor (not shown) is operatively connected to the throttle operator 91 to sense movement thereof caused by the driver in operation. The sensed input from the throttle operator position sensor is transmitted to an electronic control unit (ECU) (not sown) which controls operation of the ATV's motor 20.

A motor 20 (schematically shown in FIG. 1) is mounted to the middle portion 15 of the frame 12 and, as will be described in greater detail below, is operatively connected to the front and rear wheels 16, 18 in order to propel the ATV 10. In this embodiment, the motor 20 is an internal combustion engine, and in particular a V-type engine having two cylinders. The cylinders are disposed at an angle to each other. Each cylinder has an intake port (not shown) connected to an air induction system delivering air into the engine 20. Each cylinder has a fuel injector injecting fuel into the engine 20 and a spark plug igniting the fuel-air mixture to initiate the combustion cycle. Each cylinder has an exhaust port connected to an exhaust manifold through which the exhaust gases are removed from the engine 20. It is contemplated that other types of internal combustion engine could be used, such as, for example, an inline engine. It is also contemplated that the engine 20 could have more than two cylinders.

The engine air induction system feeds air to the engine 20 in a known manner and will thus not be described in detail here. Notably, a throttle valve is controlled by the ECU to adjust the air being fed to the engine 20 in response to input by the driver at the throttle operator 91.

It is contemplated that the engine 20 could instead be a different type of motor in other embodiments. For example, in some embodiments, the engine 20 could instead be an electric motor, in which case the engine air induction or air exhaust systems may be omitted.

A powertrain of the ATV 10 operatively connects the front and rear wheels 16, 18 to the engine 20. The powertrain notably includes the engine 20, a continuously variably transmission (CVT) and a transmission. An output shaft of the engine 20 is connected to the CVT which is in turn connected to the transmission.

Left and right front brake assemblies include the discs (not shown) and further include calipers mounted on steering knuckles to which the front wheels 16 are mounted. The calipers include brake pads and are operable to cause the brake pads to apply pressure on the respective discs.

The ATV 10 can be operated in a rear-wheel drive mode (i.e., a two-wheel drive mode) in which the rear wheels 18 are driven by the engine 20 or in a four-wheel drive mode in which the front and rear wheels 16, 18 are driven by the engine 20. To that end, in this embodiment, the transmission is selectively connected to the front wheels 16 via a drive mode coupler. The drive mode coupler is controlled by the ECU and is selectively actuated to cause the ATV 10 to change from the two-wheel drive mode configuration to the four-wheel drive mode configuration by selectively coupling the front wheels 16 to the transmission for selectively driving the front wheels 16. Such drive mode couplers are known in the art and will thus not be described in detail herein.

The selection between the drive modes is made by the driver using a drive mode switch provided in the vicinity of the driver of the ATV 10. In this embodiment, the drive mode switch is a toggle switch mounted on a dashboard of the ATV 10.

It is contemplated that, in some embodiments, only the front or the rear wheels 16, 18 may be operatively connected to the engine 20 such that only the front or the rear wheels 16, 18 are driven by the engine 20.

The implement connection system 100 connecting the plow 50 to the frame 12 will now be described in detail with reference to FIGS. 5 to 13.

Figure 8A:
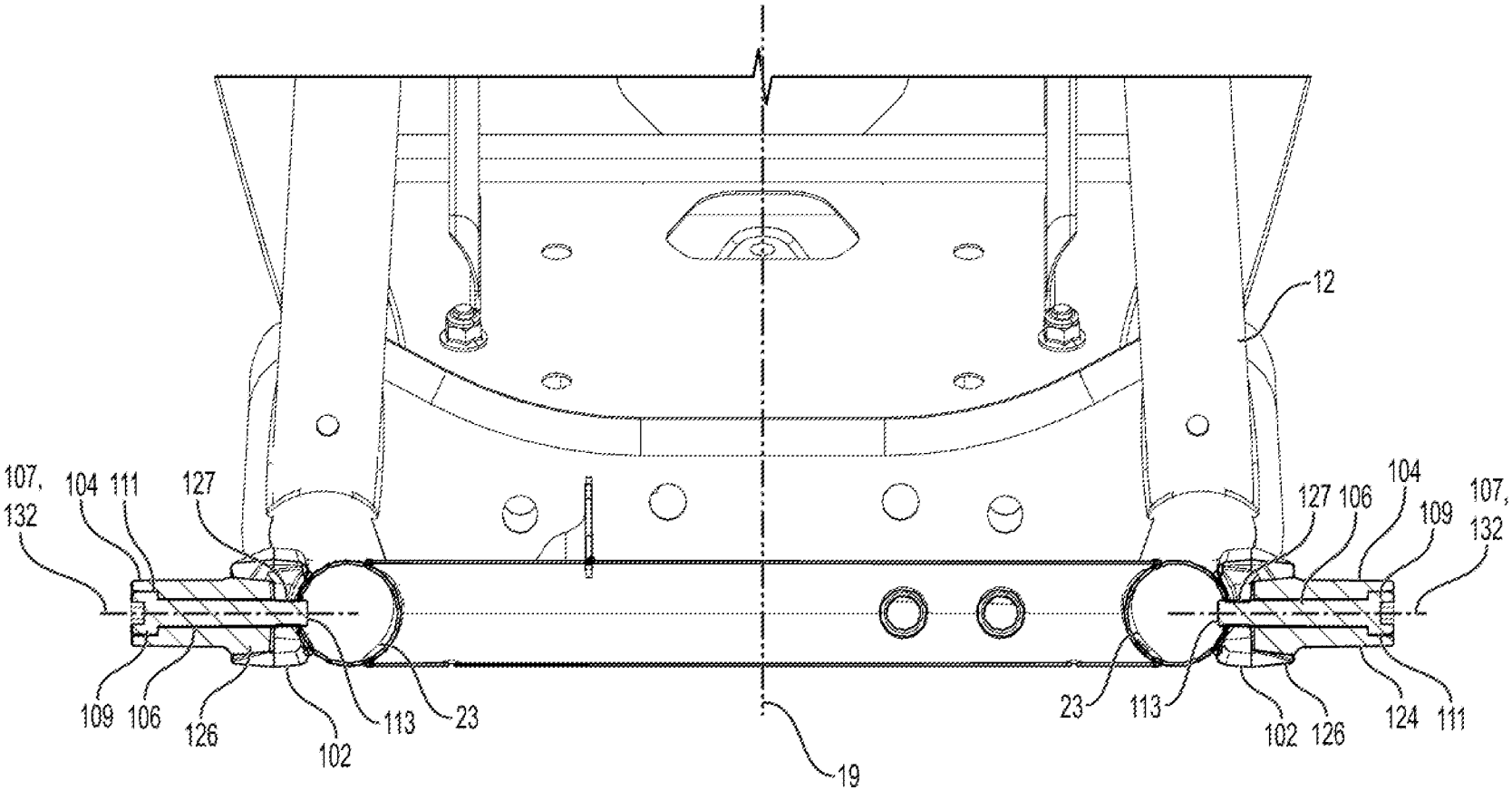
FIG. 8A is a cross-sectional view of the frame and left and right parts of the plow connection system of FIG. 5.

In this embodiment, the implement connection system 100 comprises, on the left side of the ATV 10, a left adapter 102, a left pin 104 and a left fastener 106, and on the right side of the ATV 10, a right adapter 102, a right pin 104 and a right fastener 106. As such, the implement connection system 100 has, disposed on each opposite lateral side of a longitudinal center plane 19 of the ATV 10 (see FIG. 8A), a corresponding adapter 102, pin 104 and fastener 106. In this embodiment, the left adapter 102, pin 104 and fastener 106 are longitudinally aligned with the right adapter 102, pin 104 and fastener 106 such that, for instance, an axis 132 of the left pin 104 is longitudinally aligned with an axis 132 of the right pin 104 (FIG. 8A).

Figure 3:
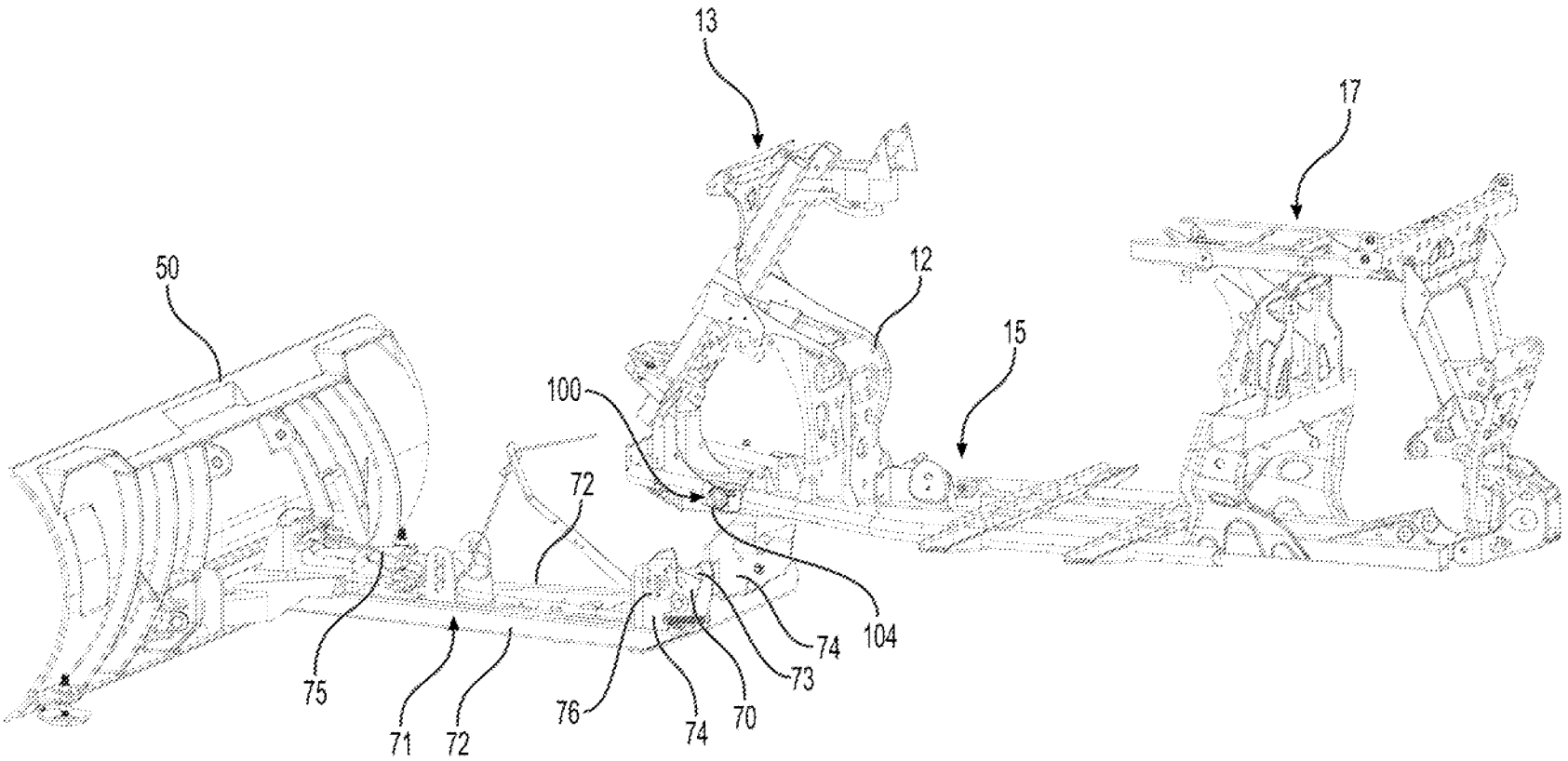
FIG. 3 is a perspective view, taken from a rear, left side, of the components of FIG. 2.
Figure 4:
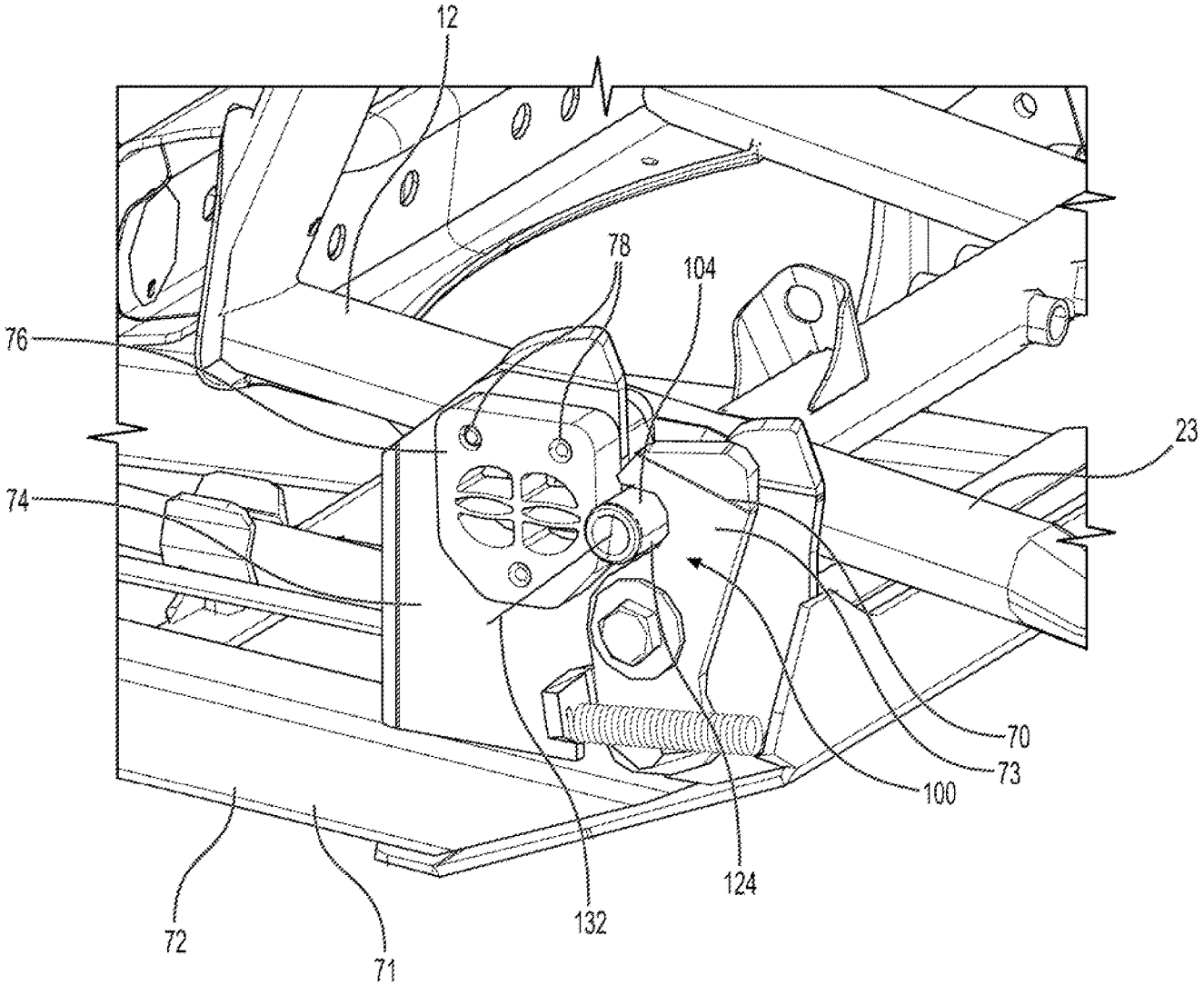
FIG. 4 is a perspective view, taken from a rear, left side, of a left plow connector connected to the frame of the vehicle of FIG. 1 via the plow connection system.
Figure 5:
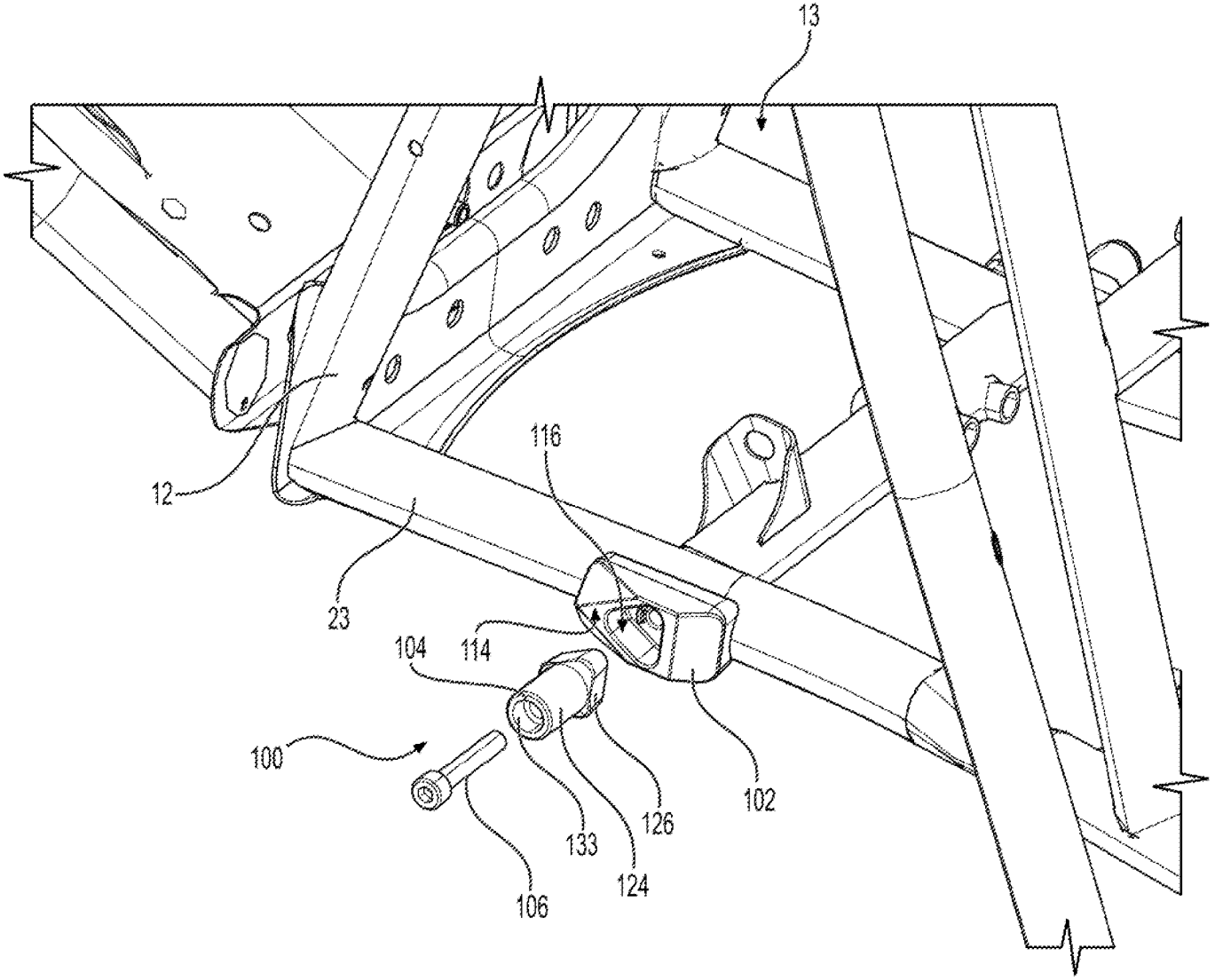
FIG. 5 is a perspective view, taken from a rear, left side, of part of the frame of the vehicle of FIG. 1 and the plow connection system in an exploded configuration.
Figure 6:
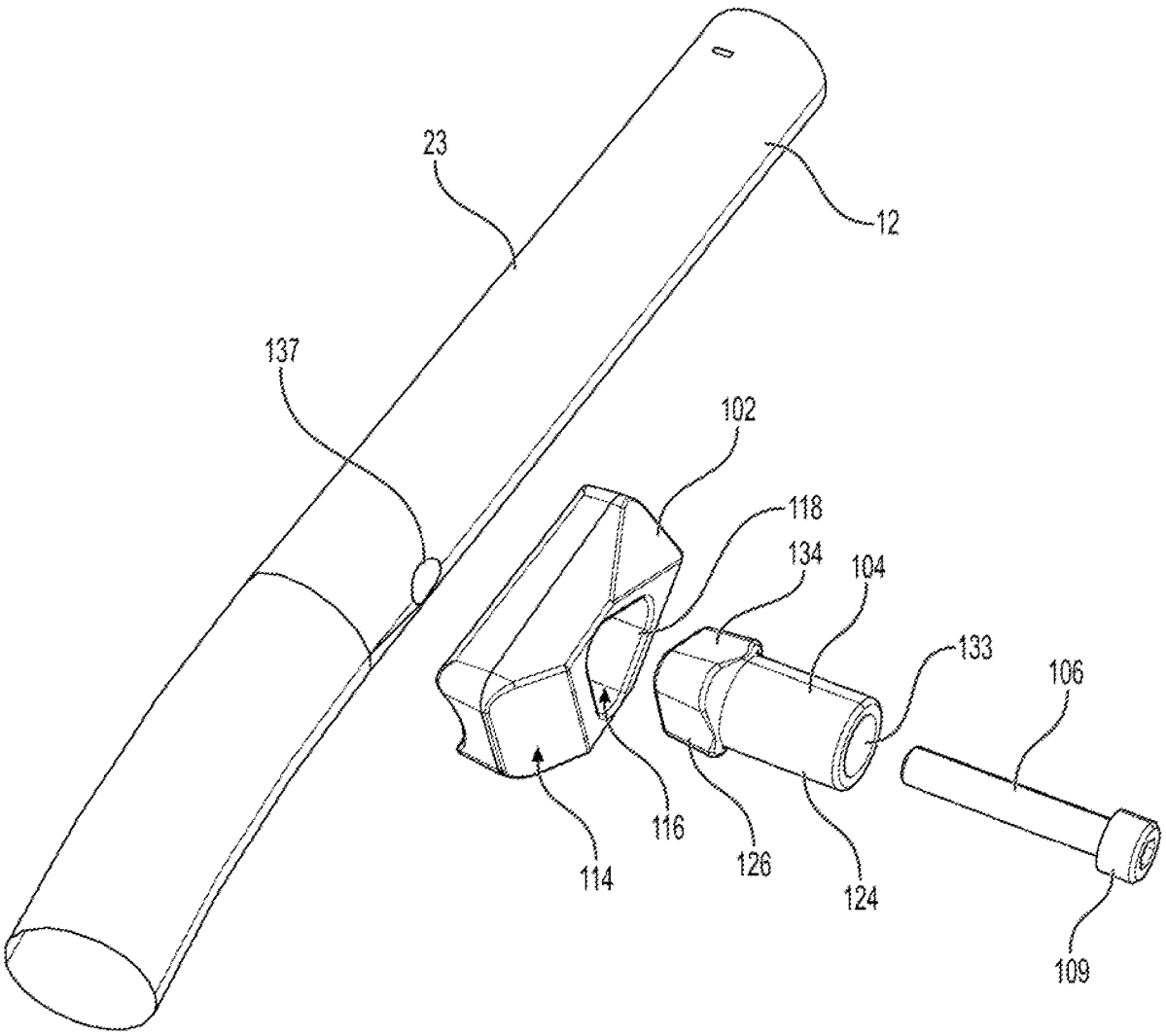
FIG. 6 is a perspective view, taken from a rear, right side of a longitudinally-extending member of the frame of the vehicle of FIG. 1 and the plow connection system in an exploded configuration.
Figure 24:
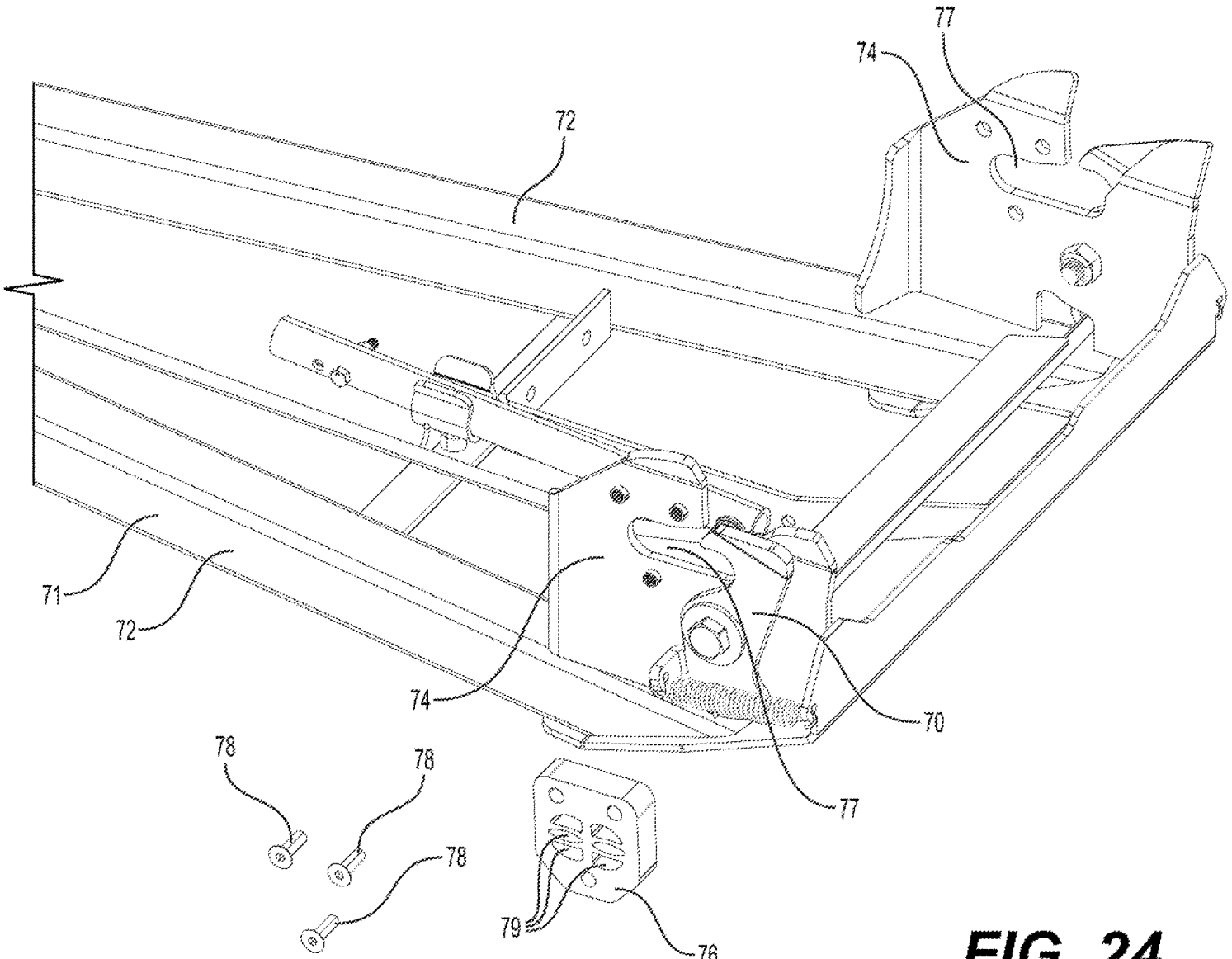
FIG. 24 is a perspective view, taken from a top, rear, left side, of a rear end portion of a push frame of the plow of FIG. 1, showing a left bumper of the plow in an exploded configuration.
Figure 25:
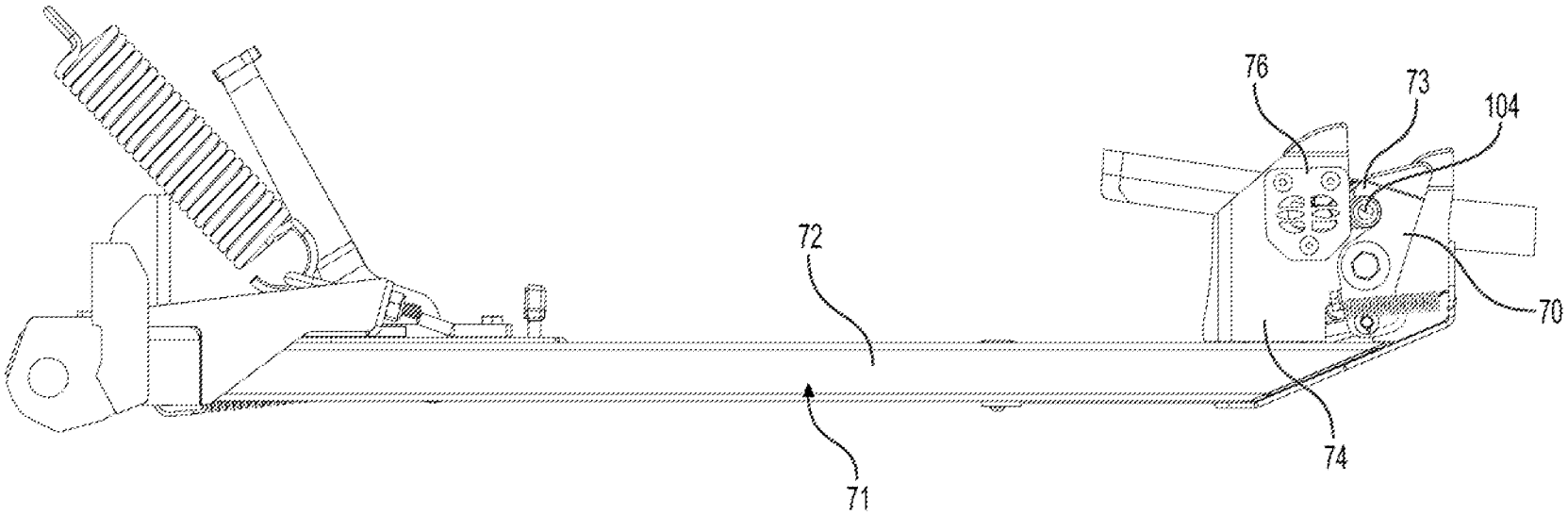
FIG. 25 is a left side elevation view of the push frame of the plow of FIG. 1.
Figure 26:
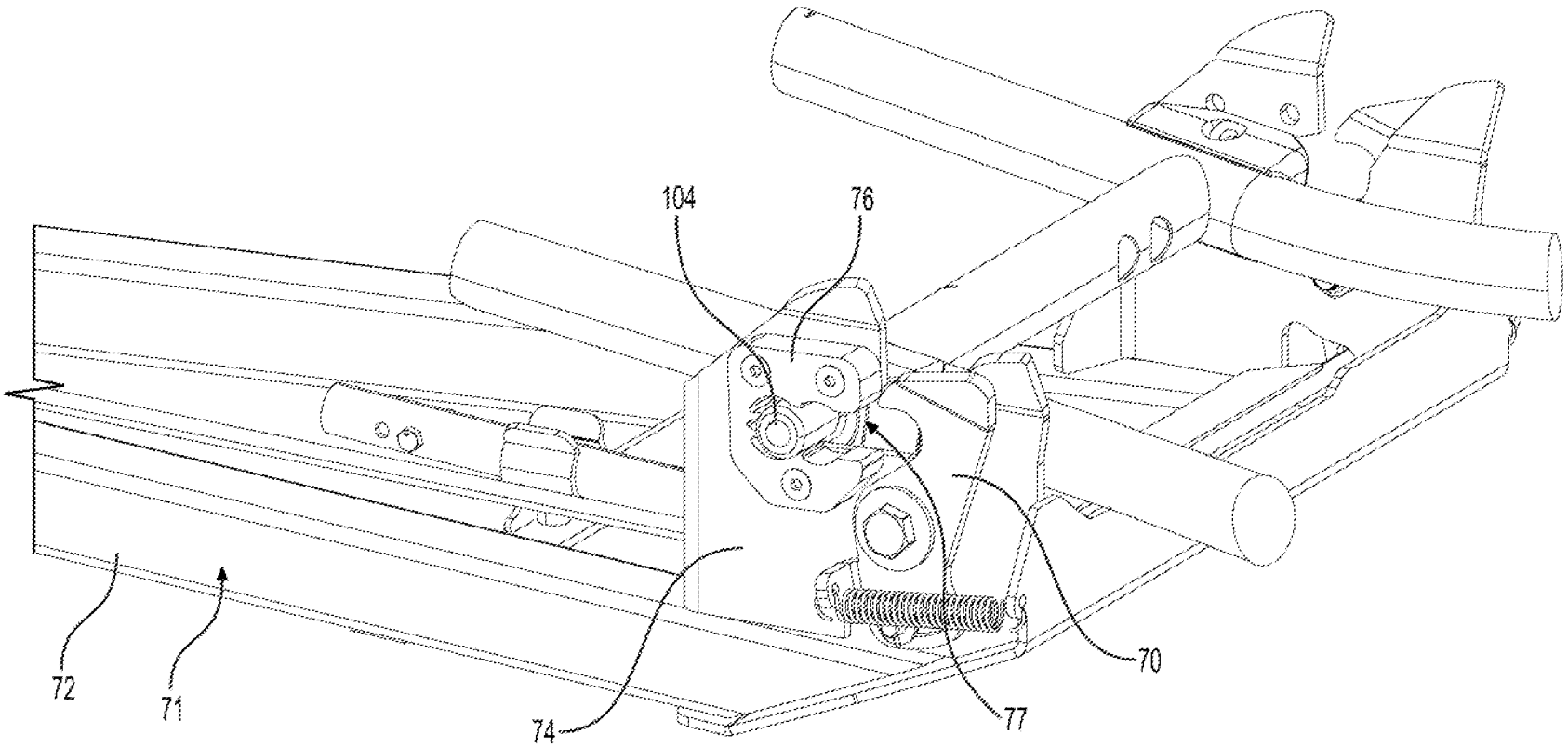
FIG. 26 is a perspective view, taken from a top, rear, left side, of the rear end portion of the push frame of the plow of FIG. 1, showing the left bumper in a worn state.

As will be described in greater detail below, the implement connection system 100 is designed to support left and right implement connectors 70 which are provided at a rear end of a push frame 71 of the plow 50. As shown in FIGS. 2 and 3, the push frame 71 includes left and right support arms 72 extending longitudinally and, respectively, leftwardly and rightwardly. The push frame 71 also includes left and right support plates 74 disposed at the rear end of the push frame 71 and extending upwardly from the left and right support arms 72 respectively. The left and right implement connectors 70 are connected to the left and right support plates 74. As shown in FIG. 4, in use, the left and right implement connectors 70 are supported by the left and right pins 104. In particular, each of the implement connectors 70 has a hooked end 73 for engaging a portion of the corresponding pin 104. Furthermore, left and right bumpers 76 are connected to the left and right support plates 74 respectively via mechanical fasteners 78 (see FIG. 4 showing the left bumper 76). The bumpers 76 are configured to limit movement of the pins 104 relative to the push frame 71 as well as prevent damage to the pins 104. In particular, as shown in FIG. 4, the left and right bumpers 76 are disposed forward of the respective pins 104 when the plow 50 is connected to the ATV 10 (i.e., when the implement connectors 70 are supported by the implement connection system 100) and are longitudinally aligned with respective recesses 77 (best shown in FIG. 24) defined by the left and right support plates 74. The recesses 77 are disposed forwardly of the implement connectors 70. As shown in FIG. 25, the bumpers 76 abut the pins 104 when the pins 104 move forward relative to the push frame 71 which can happen when the plow 50 comes into contact with a particularly heavy obstacle such as an immovable object. The bumpers 76 are made of a soft material such as a polymeric material (e.g., plastic or rubber) and therefore provide a softer material for the pins 104 to impact than the metallic material of the push frame 71. With reference to FIG. 26, after a given amount of use and/or heavy impacts, the bumpers 76 begin fracturing in a controlled manner, due in part to the apertures 79 (FIG. 24) defined by the bumpers 76 which give way under repeated stress, such that a central section of the bumpers 76 wears away. The pins 104 thus begin entering the recesses 77 upon moving forwardly, which means that the plow 50 moves a greater distance relative to the ATV 10 when the plow 50 impacts an immovable object. This increased motion of the plow 50 can alert a user that the bumpers 76 need replacing.

The implement connection system 100 will now be described in greater detail. As the left adapter 102, pin 104 and fastener 106 are a mirror image of the right adapter 102, pin 104 and fastener 106, only the left adapter 102, pin 104 and fastener 106 will be described in detail below. It is to be understood that the right adapter 102, pin 102 and fastener 106 are configured in a similar manner.

Figure 7:
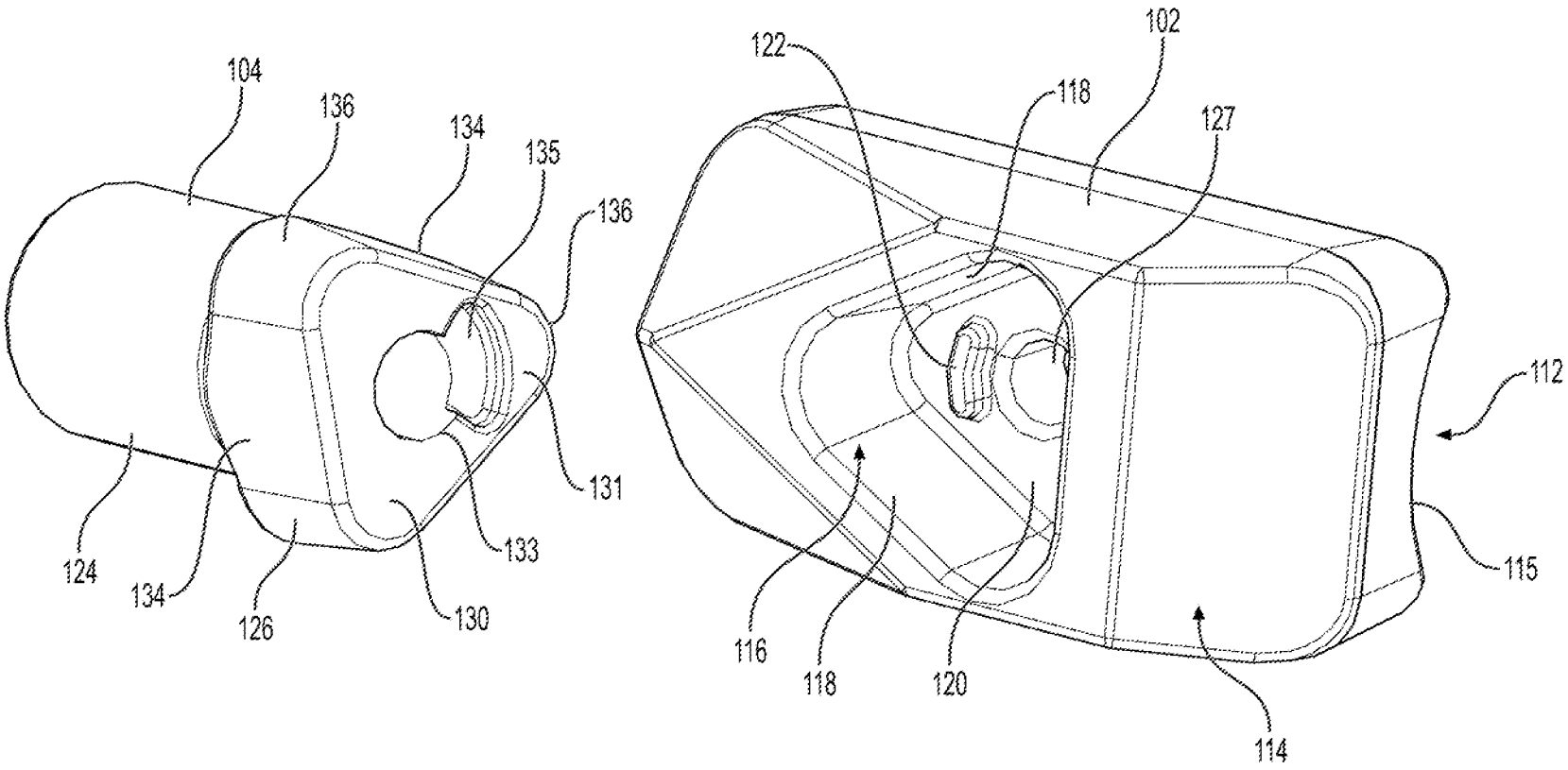
FIG. 7 is an exploded perspective view of a left adapter and pin of the plow connection system of FIG. 5.
Figure 9:
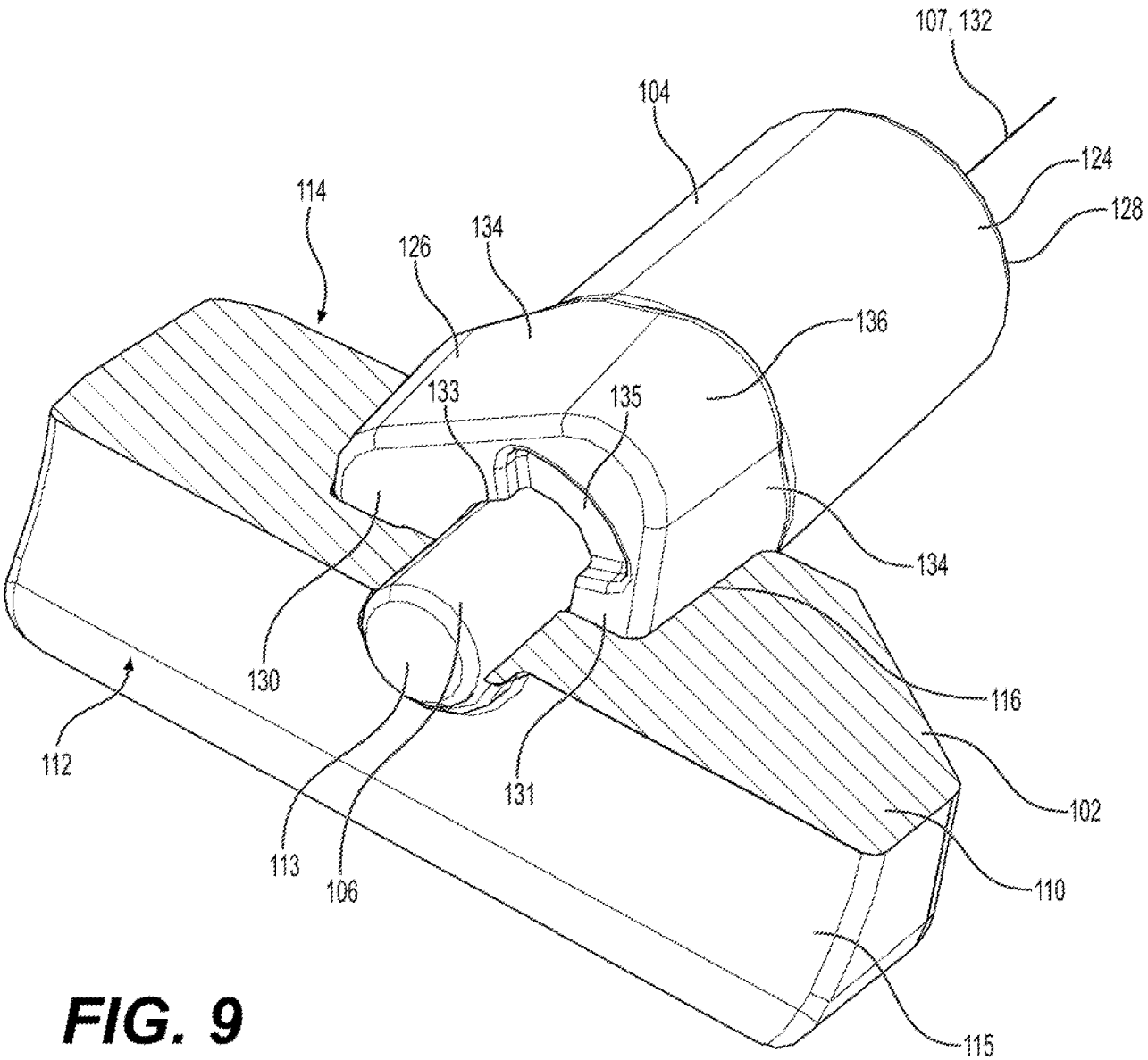
FIG. 9 is a perspective view of the right adapter and pin, and a right fastener of the plow connection system of FIG. 6, with a cross-section taken through the adapter to expose the fastener and pin connected thereto.

As shown in FIGS. 7 and 9, the adapter 102 comprises a body 110 and has a proximal side 112 and a distal side 114. The adapter 102 is fixed to a lower generally longitudinally-extending member 23 of the frame 12. More particularly, in this embodiment, the adapter 102 is welded to the longitudinally-extending member 23 of the frame 12. An outer surface 115 of the body 110, on the proximal side 112 of the adapter 102, is curved to conform to a radius of curvature of the longitudinally-extending member 23. A threaded opening 127 extending from the distal side 114 to the proximal side 112 of the adapter 102 is aligned with an opening 137 (FIG. 6) defined by the longitudinally-extending member 23 of the frame 12.

On the distal side 114 of the adapter 102, the body 110 defines a recess 116 for receiving the pin 104. In particular, the body 110 has a plurality of inner peripheral surfaces 118 which define an inner periphery of the recess 116. As will be explained below with respect to the pin 104, the recess 116 has a shape corresponding to a portion of the pin 104 and tapers toward a bottom 120 of the recess 116 facing the distal side 114.

In this embodiment, the bottom 120 of the recess 116 also has a protrusion 122 protruding outwardly therefrom, toward the distal side 114 of the adapter 102. The protrusion 122 is configured to engage a recess of the pin 104 (i.e. pin orientation feature 135 described below). It is contemplated that, in alternative embodiments, the protrusion 122 may instead be a recess configured to engage a protrusion of the pin 104. The recess bottom 120 also defines the threaded opening 127 which securely receives the fastener 106 therein.

As shown in FIGS. 10 to 14, the pin 104 has a distal portion 124 and a proximal portion 126 extending from the distal portion 124. In this embodiment, the distal portion 124 is cylindrical in shape and will thus be referred to as the cylindrical portion 124, while the proximal portion 126 is non-cylindrical in shape and will thus be referred to as the non-cylindrical portion 126. It is nonetheless contemplated that, in other embodiments, the cylindrical portion 124 and the non-cylindrical portion 126 may have shapes other than cylindrical and non-cylindrical respectively.

Figure 8B:
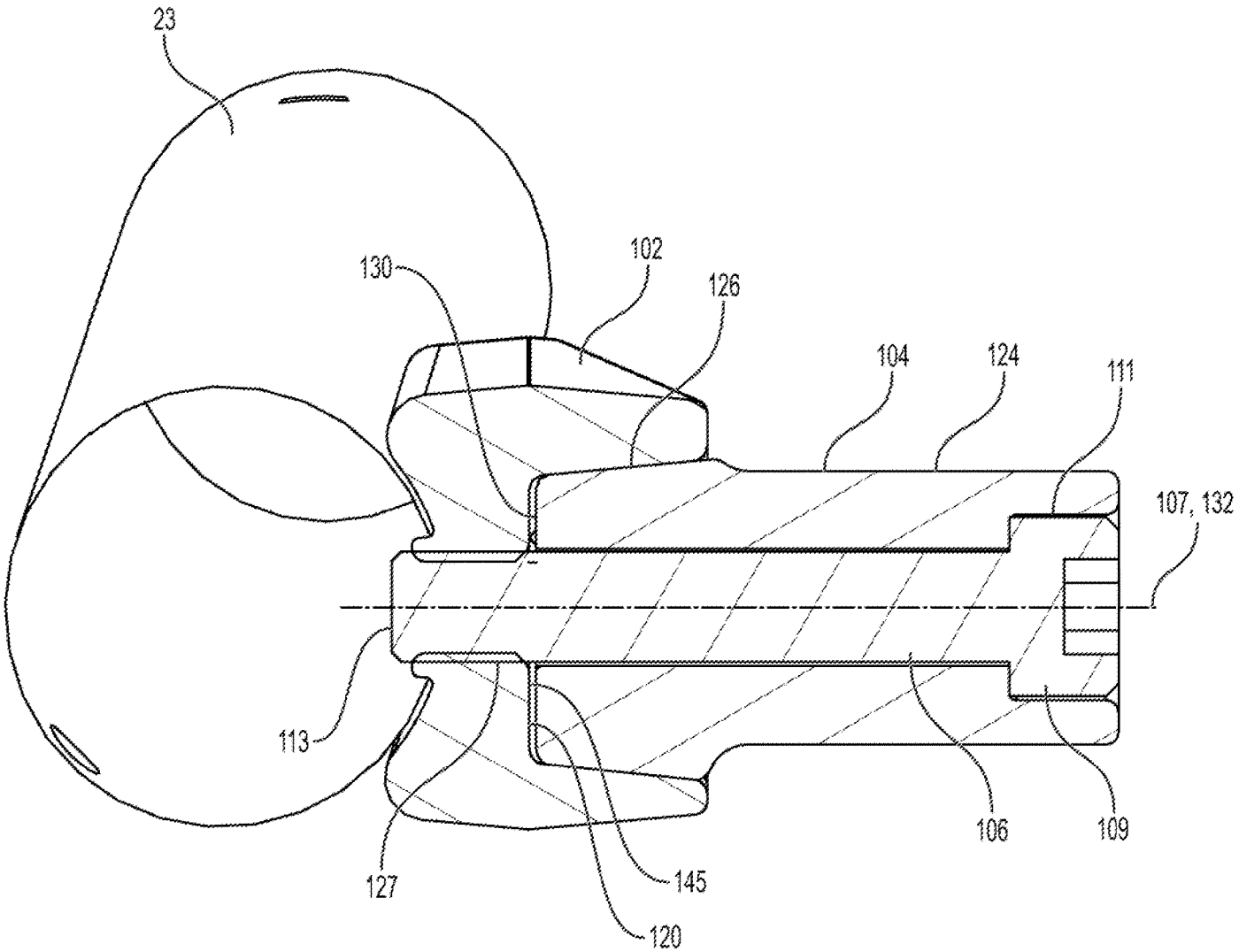
FIG. 8B is a detailed view of the left part of the plow connection system of FIG. 8A.

The cylindrical portion 124 defines a distal end 128 of the pin 104 while the non-cylindrical portion 126 defines a proximal end 130 of the pin 104. The pin 104 also defines an opening 133, in the form of a through hole, extending from the distal end 128 to the proximal end 130 which receives the fastener 106 therein. Moreover, as shown in FIG. 8B, the distal end 128 of the pin 104 defines a counterbore 111 which receives a head 109 of the fastener 106 such that the fastener 106 does not protrude from the distal end 128 of the pin 104. The counterbore 111 defines part of the opening 133 that extends from the distal end 128 to the proximal end 130 of the pin 104.

As shown in FIG. 4, the cylindrical portion 124 is received by the corresponding implement connector 70. To that end, in this embodiment, the cylindrical portion 124 has a diameter D1 (FIG. 12) suitable for supporting the hooked end 73 of the implement connector 70. Notably, via the hooked end 73, the implement connector 70 is rotatable about a central axis 132 of the cylindrical portion 124 which corresponds to a central axis of the pin 104. In this embodiment, the central axis 132 of the pin 104 extends generally laterally. The rotational motion of the implement connector 70 about the central axis 132 enables an adjustment of the angular position of the plow 50.

With reference to FIGS. 10 to 14, the non-cylindrical portion 126 of the pin 104 constitutes the portion of the pin 104 which mates with the adapter 102. To that end, the non-cylindrical portion 126 has a shape that corresponds to the shape of the recess 116 of the adapter 102. In this embodiment, the non-cylindrical portion 126 is symmetric and has a generally triangular shape. In particular, the non-cylindrical portion 126 has three planar peripheral surfaces 134 angled relative to one another and vertices 136 disposed between the planar peripheral surfaces 134. The peripheral surfaces 134 and the vertices 136 define an outer periphery of the non-cylindrical portion 126. In this embodiment, the three planar peripheral surfaces 134 are disposed equiangularly relative to one another such that an angle between two of any of the planar peripheral surfaces 134 is approximately 60°. The generally triangular shape of the non-cylindrical portion 126 is thus that of an equilateral triangle with rounded corners.

Figure 13:
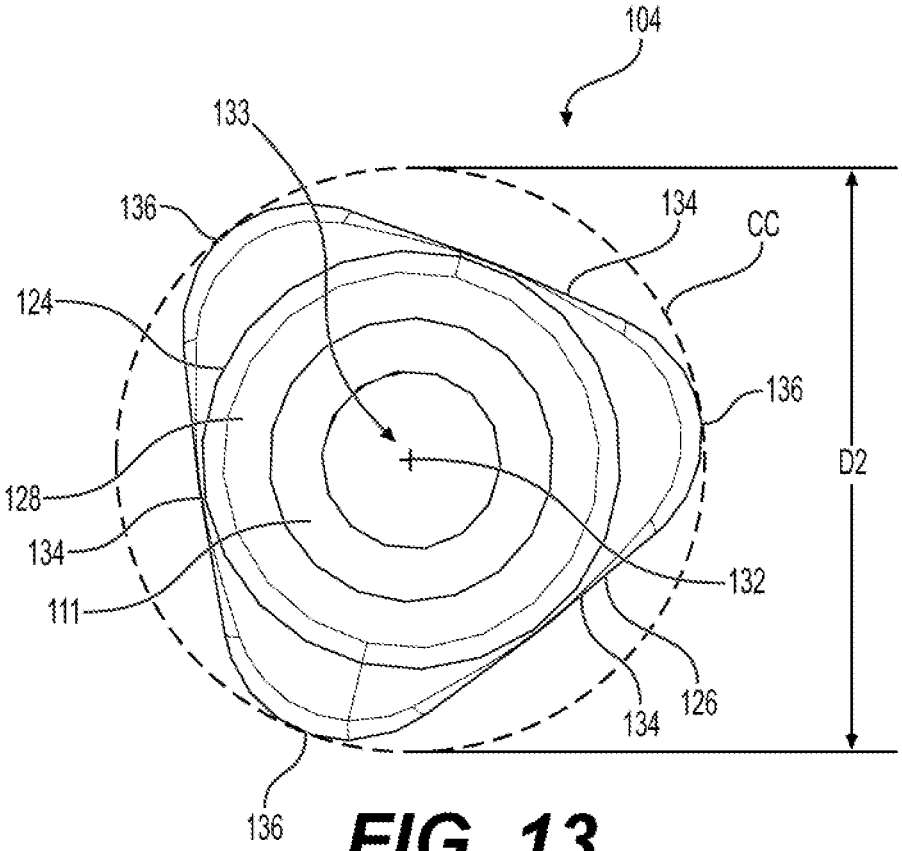
FIG. 13 is a left side elevation view of the pin of FIG. 10.
Figure 14:
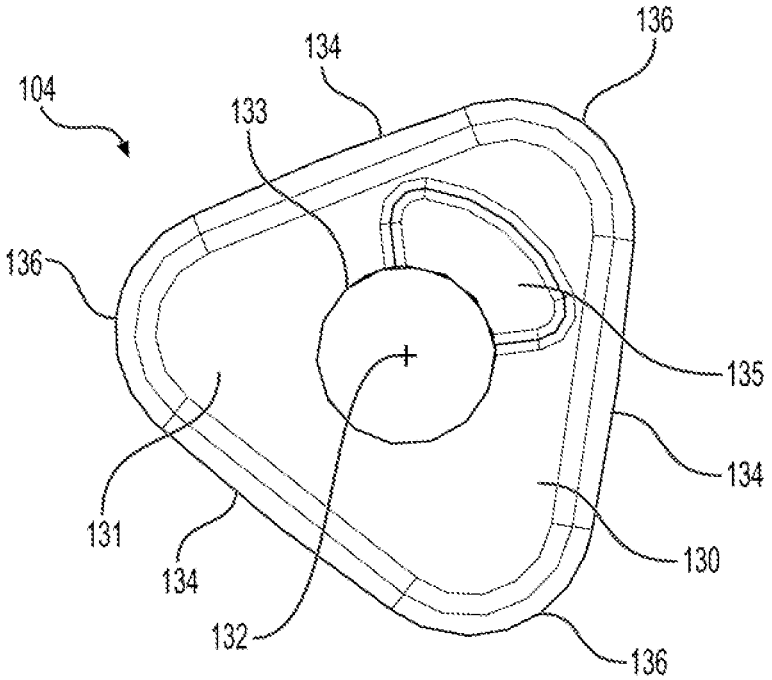
FIG. 14 is a right side elevation view of the pin of FIG. 10.

Furthermore, in this embodiment, the non-cylindrical portion 126 is larger than the cylindrical portion 124. More specifically, as shown in FIG. 13, a circumferential circle CC circumscribing the non-cylindrical portion 126 and extending through each of the vertices 136 thereof has a diameter D2 that is greater than the diameter D1 of the cylindrical portion 124. Notably, a ratio D2/D1 of the diameter D2 of the circumferential circle CC over the diameter D1 of the cylindrical portion 124 is greater than 1. It is contemplated that the ratio D2/D1 could be between 1.1 and 1.5 inclusively for example. In this embodiment, the ratio D2/D1 is approximately 1.3. The ratio D2/D1 could have any other suitable value in other embodiments.

The recess 116 of the adapter 102 has a matching generally triangular shape to that of the non-cylindrical portion 126 of the pin 104 such that the peripheral surfaces 134 of the non-cylindrical portion 126 mate with the inner peripheral surfaces 118 defining the recess 116. This mating between the surfaces of the recess 116 and the non-cylindrical portion 126 of the pin 104 minimizes bending between the pin 104 and the adapter 102 and, moreover, decreases a bending moment and shear force applied to the fastener 106 via the push frame 71 of the plow 50.

Furthermore, in this embodiment, the non-cylindrical portion 126 tapers toward the proximal end 130 such that a perimeter of the generally triangular shape of the non-cylindrical portion 126 decreases toward the proximal end 130 (and is thus smallest at the proximal end 130). As briefly described above, the recess 116 defined by the adapter 102 similarly tapers toward the recess bottom 120 (i.e., toward the proximal side 112 of the adapter 102) such that the perimeter of the recess 116 decreases toward the recess bottom 120. This tapering of the non-cylindrical portion 126 of the pin 104 and the recess 116 of the adapter 102 may help reduce play between the peripheral surfaces 134 of the non-cylindrical portion 126 and the inner peripheral surfaces 118 defining the recess 116 as these surfaces further engage one another as the non-cylindrical portion 126 of the pin 104 is inserted further into the recess 116 of the adapter 102. Furthermore, with particular reference to FIG. 8B, the tapering of the non-cylindrical portion 126 and the recess 116 are arranged such that, once the peripheral surfaces 134, 118 abut one another (i.e., when the non-cylindrical portion 126 cannot be inserted further into the recess 116), a gap 145 is defined between the proximal end 130 of the pin 104 and the recess bottom 120. The presence of the gap 145 helps ensure that there is no play between the non-cylindrical portion 126 of the pin 104 and the recess 116.

Figure 10:
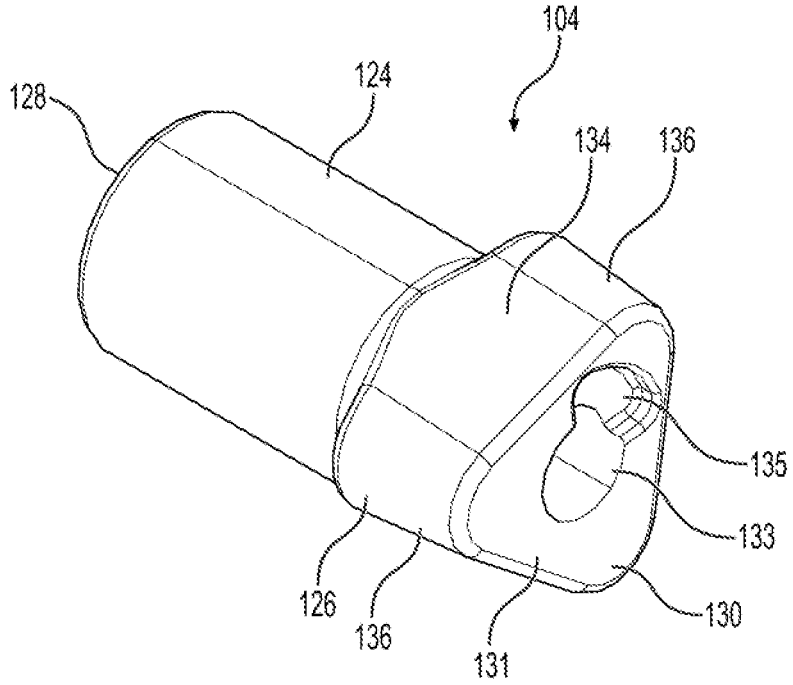
FIG. 10 is a perspective view, taken from a rear, right side, of the pin of the plow connection system of FIG. 5.
Figure 11:
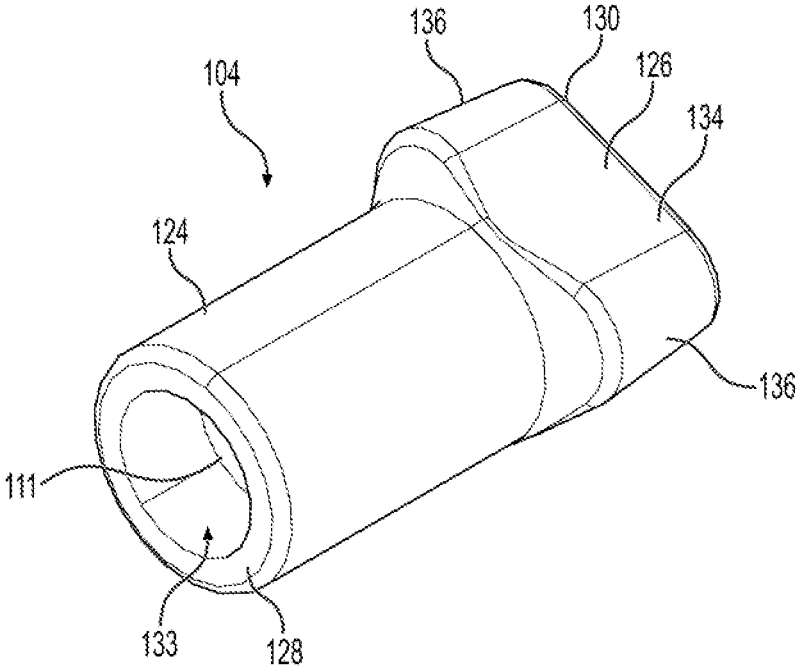
FIG. 11 is a perspective view, taken from a rear, left side, of the pin of FIG. 10.
Figure 12:
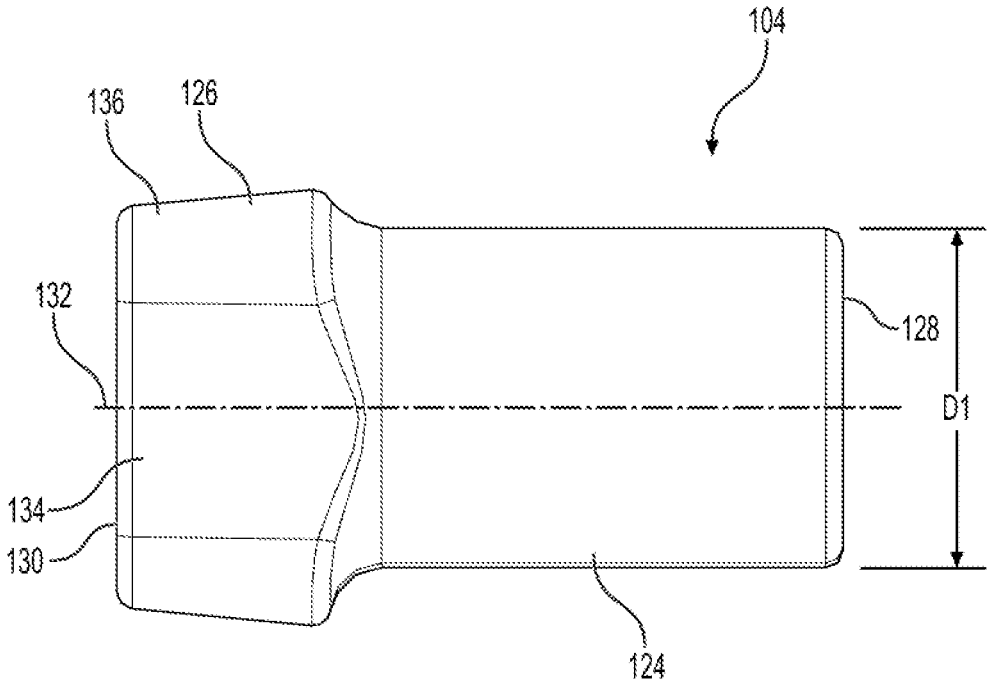
FIG. 12 is a front side elevation view of the pin of FIG. 10.

In this embodiment, the non-cylindrical portion 126 of the pin 104 also defines a pin orientation feature 135 for orienting the pin 104 on the adapter 102. More particularly, the pin orientation feature 135 is a recess defined in a transverse surface 131 of the non-cylindrical portion 126 that defines the proximal end 130 of the pin 104. The transverse surface 131 is normal to the central axis 132 of the cylindrical portion 124. The recess 135 has a shape corresponding to that of the protrusion 122 on the recess bottom 120 of the recess 116. More specifically, in this embodiment, the recess 135 has the shape of a quarter annulus centered about the central axis 132. Moreover, as seen in FIG. 10, an inner radial side of the recess 135 opens into the opening 133. Thus as the non-cylindrical portion 126 of the pin 104 is inserted into the recess 116 of the adapter 102, the recess 135 is aligned with the protrusion 122 in order to ensure proper mating between the pin 104 and the adapter 102. Alternatively, in other embodiments, the pin orientation feature 135 could be a protrusion extending from the transverse surface 131 and the protrusion 122 of the recess bottom 120 could be replaced by a matching recess.

Figure 16:
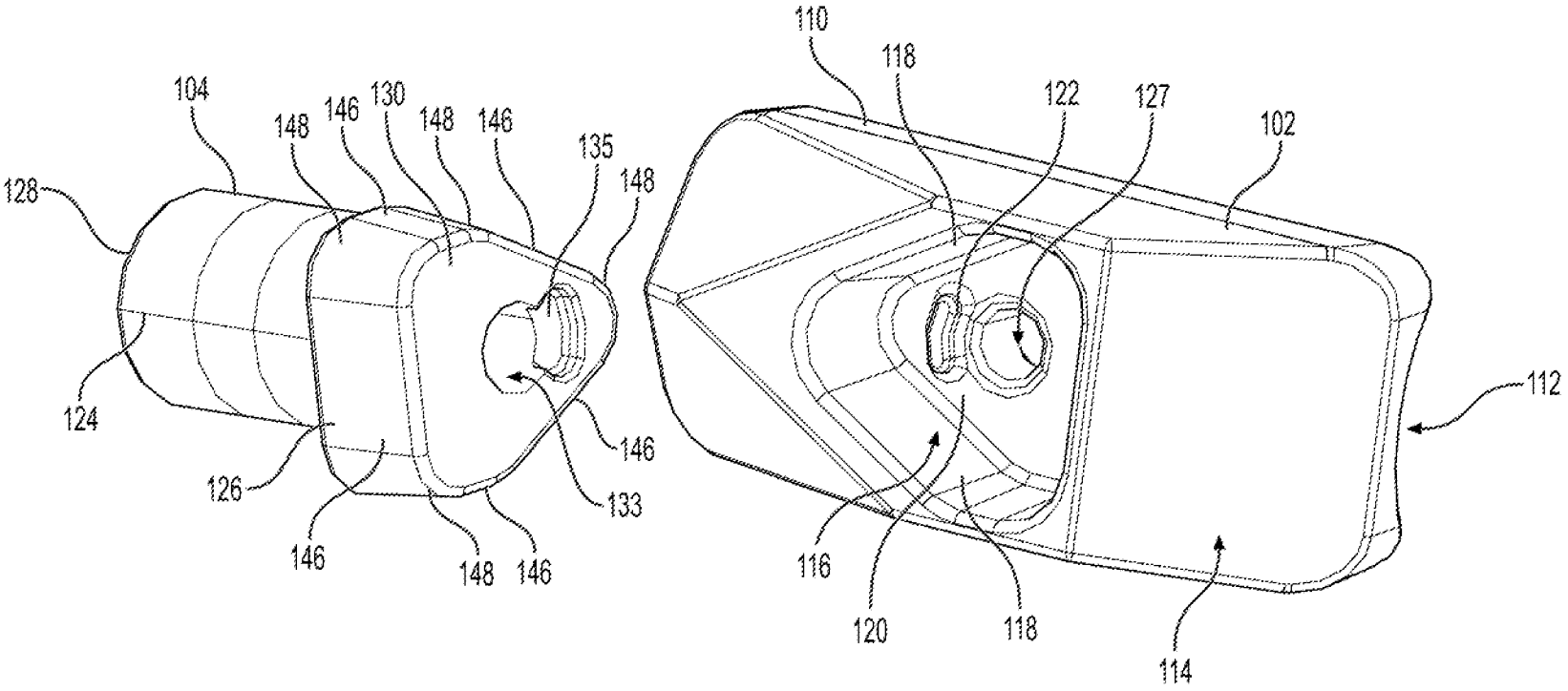
FIG. 16 is an exploded perspective view of a left adapter and pin of the plow connection system in accordance with another embodiment.

It is contemplated that the non-cylindrical portion 126 may have a shape other than the generally triangular shape illustrated herein. For instance, as shown in FIG. 16, in alternative embodiments, the non-cylindrical portion 126 of the pin 104 is generally pentagonal. Notably, in this embodiment, the non-cylindrical portion 126 has five planar peripheral surfaces 146 and fives vertices 148 disposed therebetween. The recess 116 has a matching generally pentagonal shape defined by the inner peripheral surfaces 118 thereof.

Figure 17:
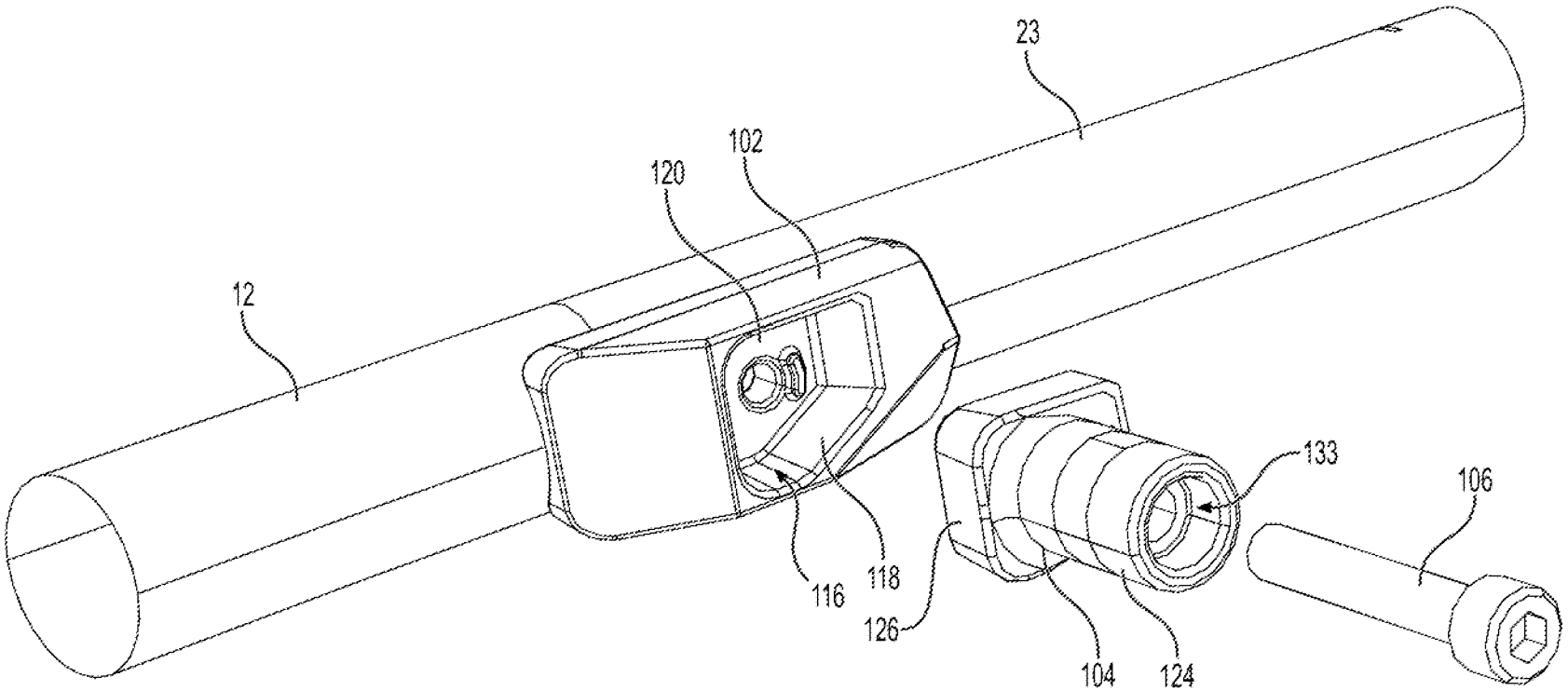
FIG. 17 is a perspective view, taken from a rear, right side of the longitudinally-extending member of the frame and the plow connection system in an exploded configuration in accordance with another embodiment.
Figure 18:
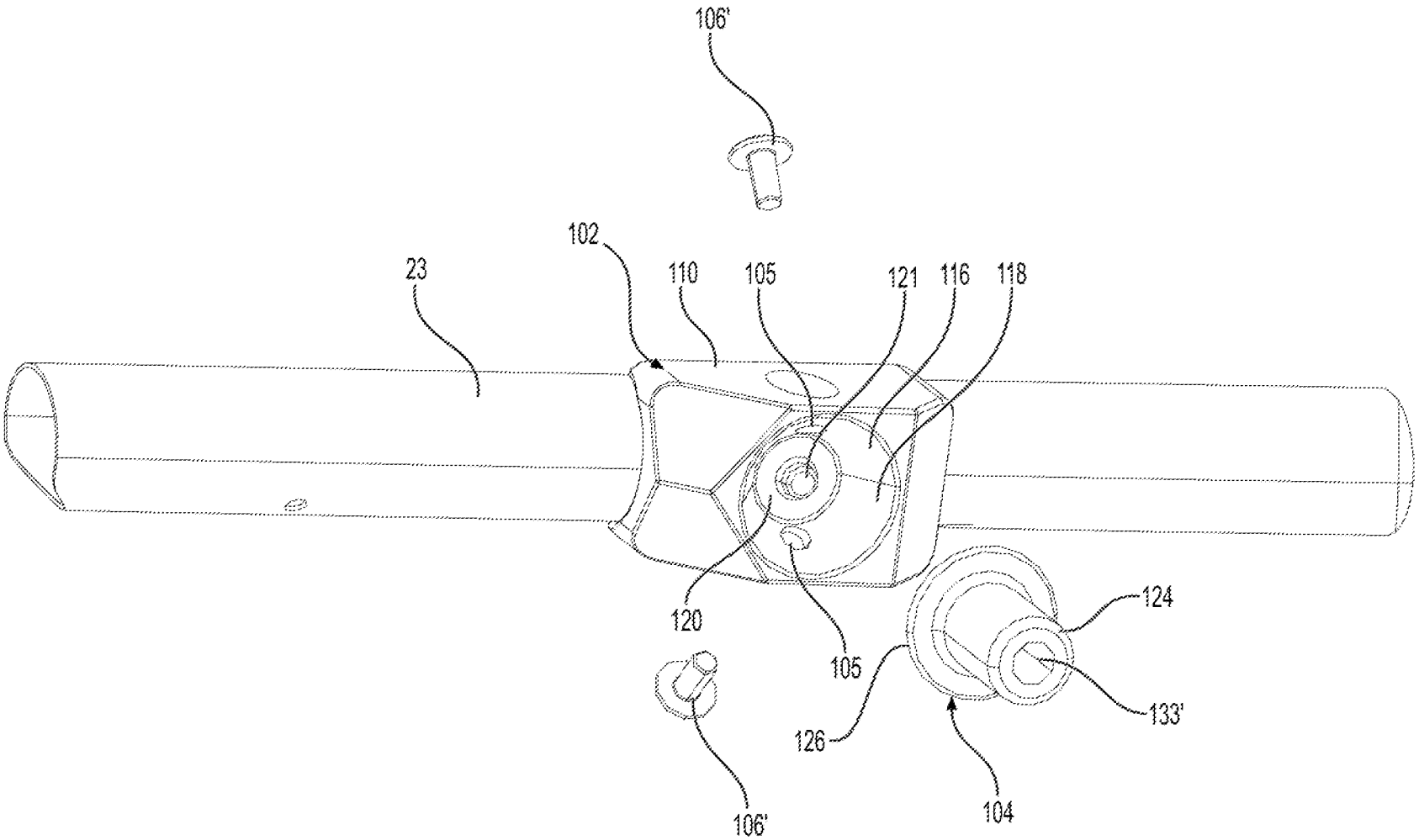
FIG. 18 is a perspective view, taken from a front, left side, of the longitudinally-extending member of the frame and the plow connection system in accordance with another embodiment, shown in an exploded configuration.
Figure 19:
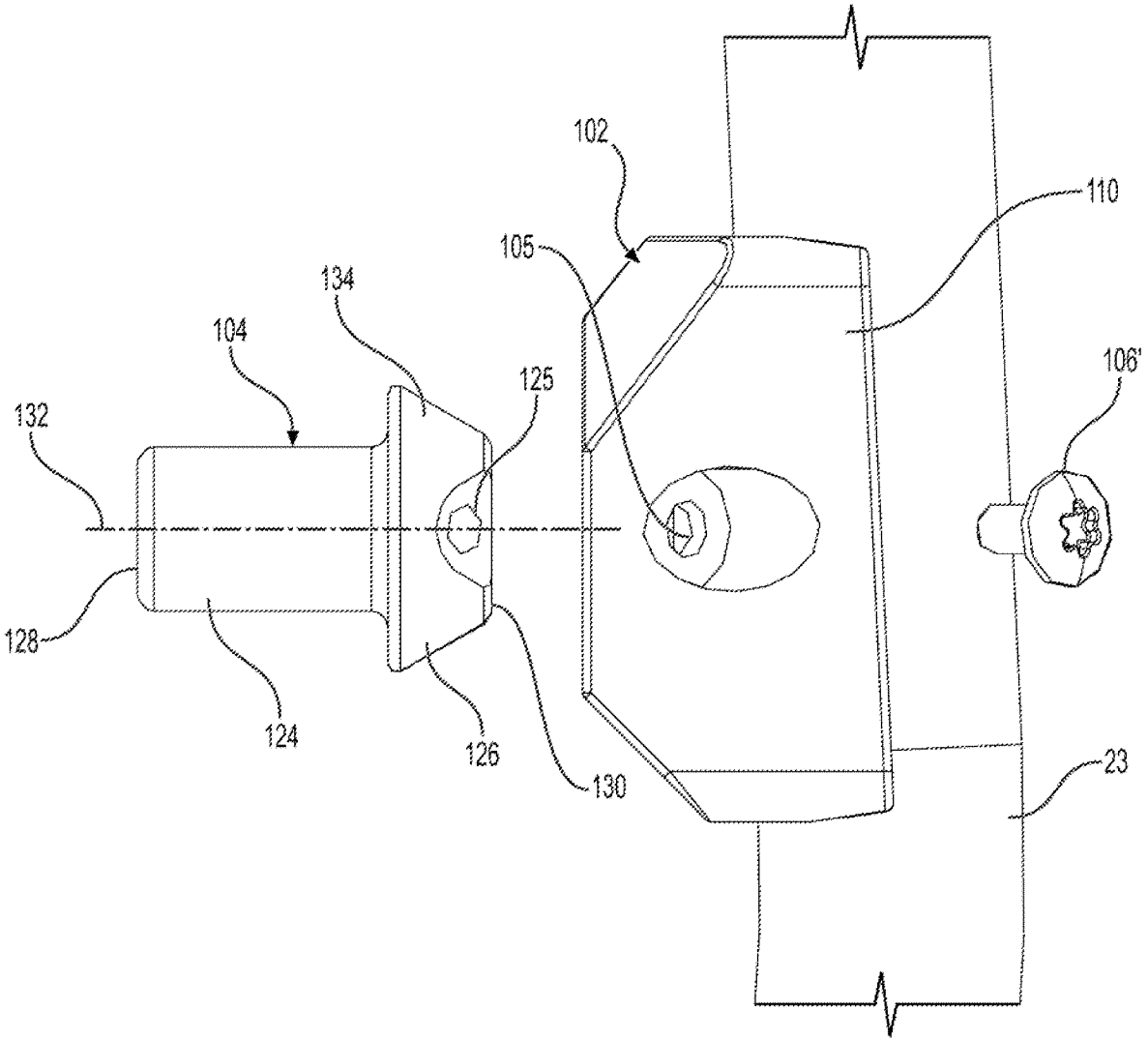
FIG. 19 is a top plan view of the longitudinally-extending member of the frame and the plow connection system of FIG. 18 in the exploded configuration.
Figure 20:
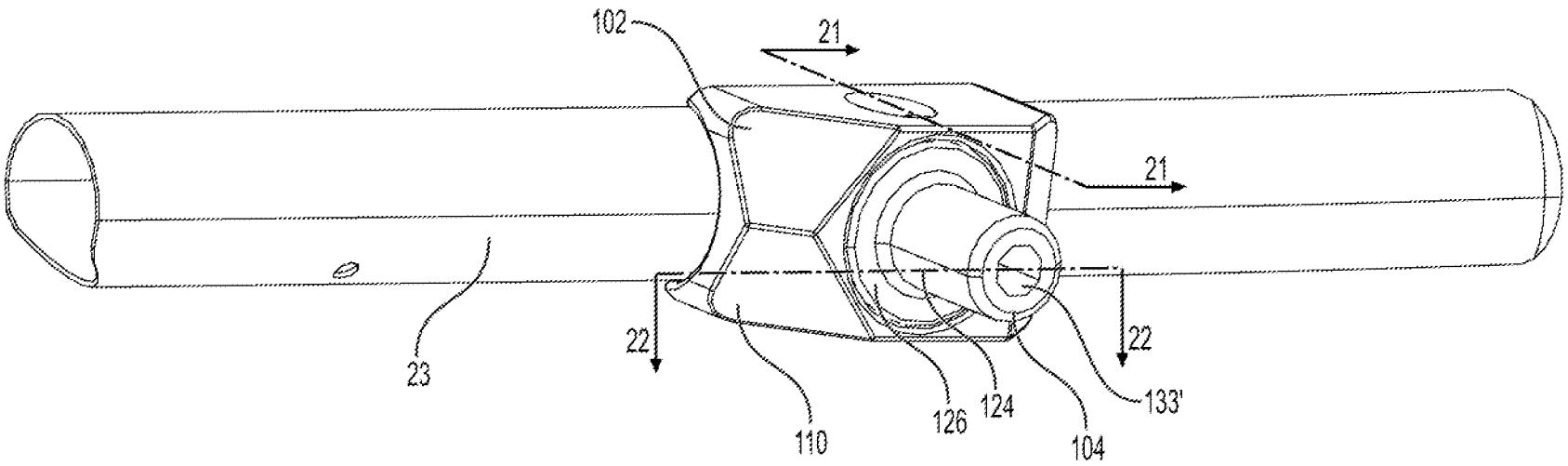
FIG. 20 is a perspective view, taken from a front, left side, of the longitudinally-extending member of the frame and the plow connection system of FIG. 18 in an assembled configuration.

In other alternative embodiments, the non-cylindrical portion 126 may have a generally asymmetric shape. For instance, the non-cylindrical portion 126 could have any other suitable type of polygonal shape such as the one shown in FIG. 17. The recess 116 of the adapter 102 also has a matching asymmetric shape. The asymmetric shape of the non-cylindrical portion 126 and the recess 116 may be helpful to ensure a particular orientation of the pin 104 relative to the frame 12 since the asymmetric shape of the non-cylindrical portion 126 can only be inserted into the matching recess 116 in a particular orientation. Thus, in such an embodiment, the pin orientation feature 135 of the pin 104 could also be omitted as the asymmetric shape of the non-cylindrical portion 126 and recess 116 may in itself ensure the proper orientation of the pin 104 relative to the adapter 102.

As seen in FIGS. 8A and 8B, the fastener 106 extends through the pin 104 and the adapter 102 and securely engages the frame 12 in order to removably fasten the pin 104 to the adapter 102 and thereby the frame 12. Notably, the fastener 106 is inserted into the opening 133 of the pin 104 and engages the threaded opening 127 of the adapter 102. As shown in FIGS. 8A and 8B, a tip 113 of the fastener 106 traversing the threaded opening 127 extends through the opening 137 (FIG. 6) defined by the tubular longitudinally-extending member 23 of the frame 12 to connect the pin 104 thereto. As such, as shown in FIGS. 8A, 8B and 9, a fastener axis 107 along which the fastener 106 extends is coaxial with the central axis 132 of the pin 104. When the pin 104 is fastened to the longitudinally-extending member 23 of the frame 12 by the fastener 106, the proximal end 130 of the pin 104 is disposed between the distal end 128 of the pin 104 and the longitudinally-extending member 23 of the frame 12.

Figure 15:
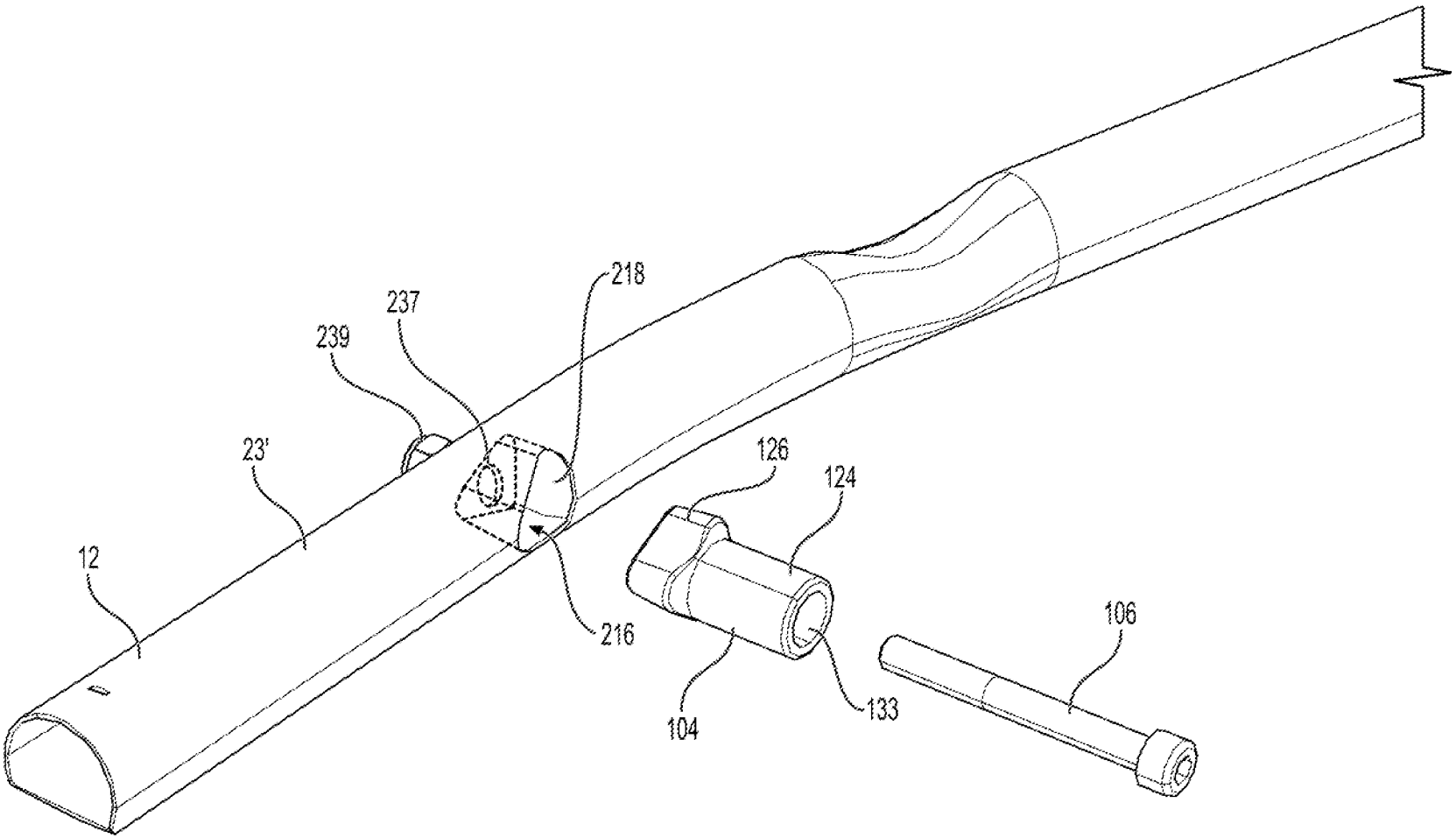
FIG. 15 is a perspective view, taken from a front, left side, of the longitudinally-extending member of the frame and the plow connection system in accordance with a variant in which the plow connection system does not include the adapter.

A variant of the implement connection system 100 is shown in FIG. 15 in which the adapter 102 is omitted. In place of the adapter 102, the pin 104 is mated with a longitudinally-extending member 23' of the frame 12 which is non-tubular (i.e., solid) and defines a recess 216 bounded by inner peripheral surfaces 218. Similarly to the recess 116 of the adapter 102, the recess 216 has a matching shape to that of the non-cylindrical portion 126 of the pin 104 such that the peripheral surfaces 134 of the non-cylindrical portion 126 mate with the inner peripheral surfaces 218 defining the recess 216. Moreover, the recess 216 also tapers toward the recess bottom which defines an opening 237 for receiving the fastener 106 therein. The non-cylindrical portion 126 of the pin 104 is thus inserted into the recess 216 and the fastener 106 is inserted into the opening 133 of the pin. The fastener 106 extends laterally through the longitudinally-extending member 23' and is securely received on an opposite thereof by a nut 239 such that the fastener 106 retains the pin 104 to the frame 12. It is contemplated that the fastener 106 could be inserted from the opposite direction such that the fastener 106 is inserted from a side of the longitudinally-extending member 23' opposite the pin 104, into the opening 237 and into the opening 133. The nut 239 would thus be at the distal end 128 of the pin 104 receiving the fastener 106, or the nut 239 could be omitted and the opening 133 could be threaded to securely receive the fastener 106 therein.

Alternatively, in other embodiments, the longitudinally-extending member 23' could be tubular and the recess 216 could instead be defined by a plug inserted into the longitudinally-extending member 23' and welded thereto. In yet other embodiments, the longitudinally-extending member 23' could be tubular and the recess 216 could be punched into the longitudinally-extending member 23' (i.e., part of the outer wall of the longitudinally-extending member 23' could be deformed to form the recess 216).

FIGS. 18 to 22 illustrate another alternative embodiment of the implement connection system 100. In this alternative embodiment, the non-cylindrical portion 126 of the pin 104 has a generally truncated conical shape, with the wider end thereof being closest to the cylindrical portion 124 of the pin 104 such that the non-cylindrical portion 126 tapers toward the proximal end 130 of the pin 104. As can be seen, a maximum diameter of the truncated conical shape of the non-cylindrical portion 126 is greater than a diameter of the cylindrical portion 124. The recess 116 of the adapter 102 has a matching shape to that of the non-cylindrical portion 126. Notably, the inner peripheral surface 118 of the recess 116 is generally conical so as to receive the non-cylindrical portion 126.

Figure 21:
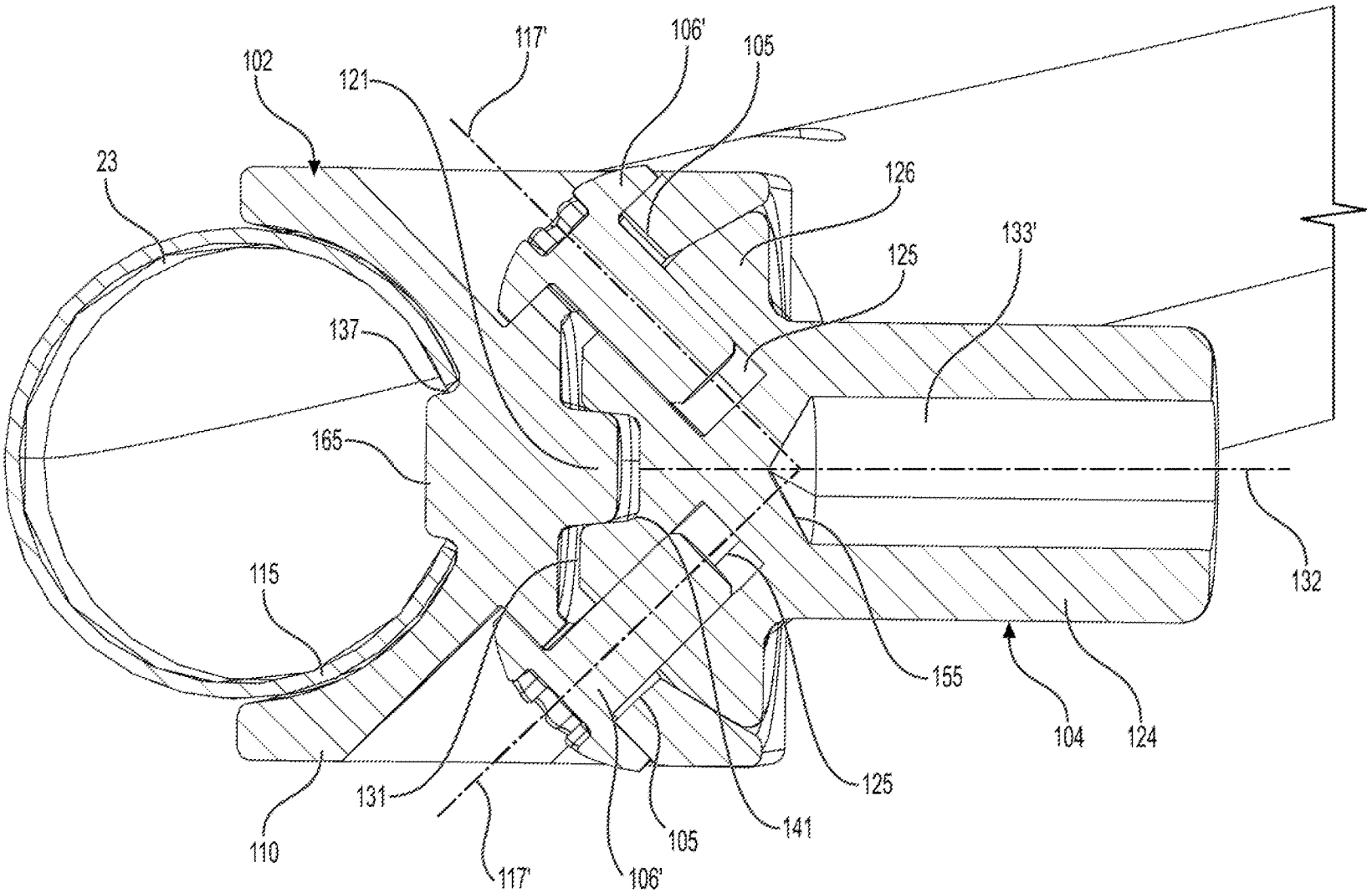
FIG. 21 is a cross-sectional view of the longitudinally-extending member of the frame and the plow connection system of FIG. 18 taken along line 21-21 in FIG. 20.

Furthermore, in this alternative embodiment, the cylindrical portion 124 of the pin 104 is hollow, namely defining a central opening 133' extending along the central axis 132. As opposed to the opening 133 described above, the opening 133' is a blind hole rather than a through hole (i.e., the opening 133' has an open end and a closed end). Notably, as shown in FIG. 21, the opening 133' is defined in part by an opening bottom 155 disposed between the proximal and distal ends 130, 128 of the pin 104. In this alternative embodiment, the opening 133' is not configured to receive a fastener and rather is configured to remain empty. In particular, the opening 133' reduces a capacity of the cylindrical portion 124 to support mechanical stress (as opposed to if no opening 133' were provided). As such, the opening 133' provides the cylindrical portion 124 as a sacrificial member in that, in case of excessive mechanical stress applied to the implement connection system 100, the cylindrical portion 124 will fail to avoid damage to the longitudinally-extending members 23 of the frame 12 (which would be more costly to repair than providing a replacement pin 104).

Figure 22:
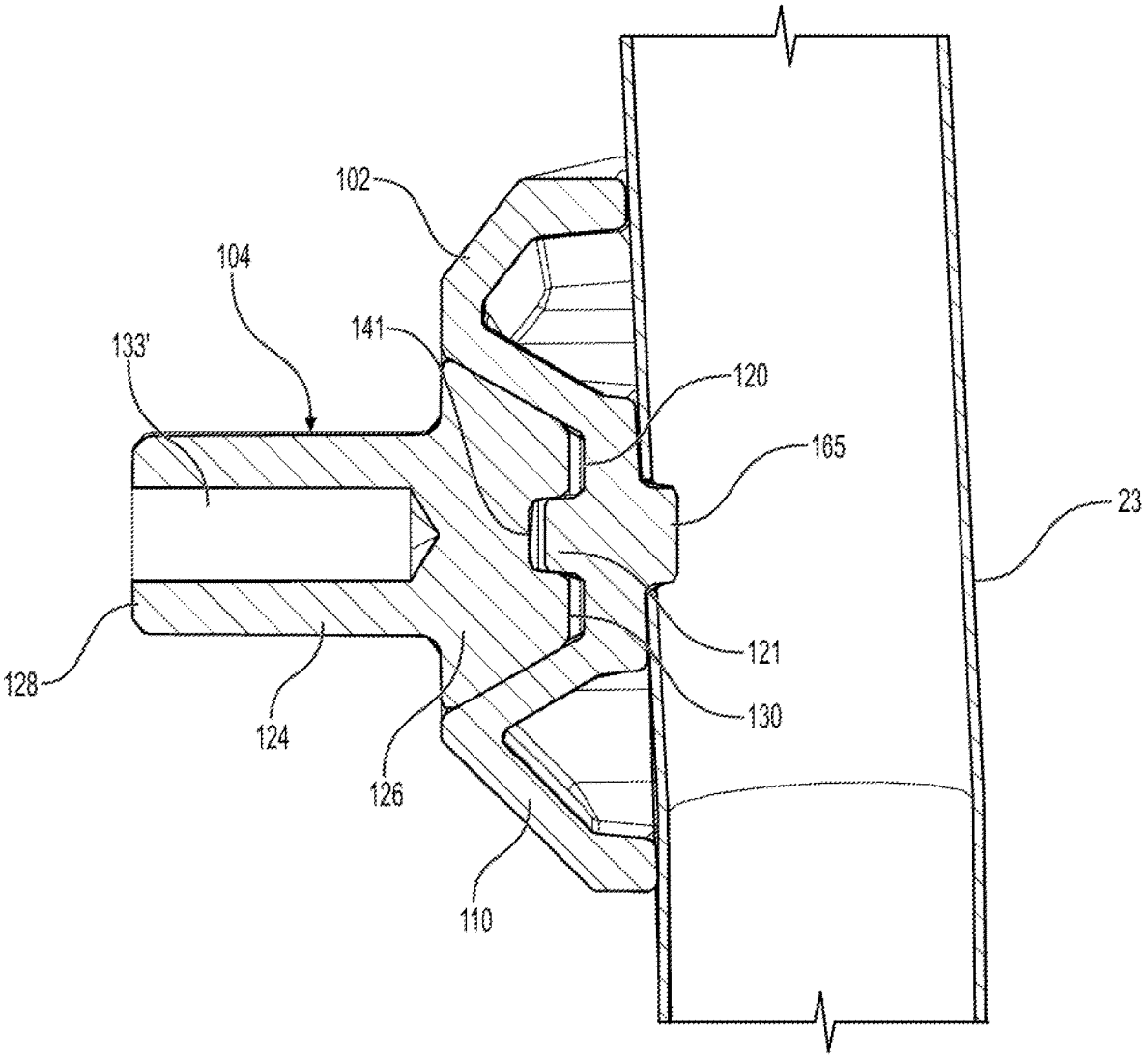
FIG. 22 is a cross-sectional view of the longitudinally-extending member of the frame and the plow connection system of FIG. 18 taken along line 22-22 in FIG. 20.

Moreover, as shown in FIGS. 21 and 22, in this alternative embodiment, the adapter 102 is connected to the longitudinally-extending member 23 by an inwardly-extending protrusion 165 extending from the outer surface 115 of the adapter 102. In particular, the protrusion 165 extends through the opening 137 of the longitudinally-extending member 23. In addition, the recess bottom 120 of the adapter 102 defines a protrusion 121 that is received in a proximal end recess 141 defined by the transverse surface 131 at the proximal end 130 of the pin 104. The proximal end recess 141 is coaxial with the central axis 132 of the pin 104. Receiving the protrusion 121 within the proximal end recess 141 limits movement of the pin 104 relative to the adapter 102, particularly decreasing bending moments about the pin 104. The protrusion 121 may thus be referred to as a "movement limiting feature". The protrusion 121 thus supports the pin 104, notably being subject to loads that are exerted on the pin 104.

Furthermore, as shown in FIG. 21, in this alternative embodiment, two fasteners 106' extend into the pin 104 to removably fasten the pin 104 to the corresponding longitudinally-extending member 23 of the frame 12 of the ATV 10. In this alternative embodiment, the fasteners 106' do not extend along the central axis 132 of the pin 104. Rather, as best shown in FIG. 21, a respective fastener axis 117 of each of the fasteners 106' extends at an angle relative to the central axis 132 of the pin 102. The fasteners 106' are disposed such that a plane contains the axes 117 of the fasteners 106' as well as the central axis 132. More specifically, in this alternative embodiment, the peripheral surface 134 of the non-cylindrical portion 126 of the pin 104 defines two openings 125 extending at an angle relative to one another and configured to receive the fasteners 106'. The fasteners 106' thus extend through respective openings 105 defined by the adapter 102 (opening into the recess 116) and into the openings 125 of the non-cylindrical portion 126 of the pin 104. In this alternative embodiment, the fasteners 106' are provided to retain the pin 104 in place but are not subjected to the loads exerted on the pin 104. That is, the fasteners 106' are subjected to negligible loads during use. Moreover, the fasteners 106' are designed as sacrificial members in that, in case of excessive mechanical stress applied to the implement connection system 100, the fasteners 106' will fail to avoid damage to the longitudinally-extending members 23 of the frame 12 (which would be more costly to repair than providing replacement fasteners 106'). Thus, as will be appreciated, in this alternative embodiment, both the fasteners 106' and the cylindrical portion 124 of the pin 104 are provided as safeguards to avoid damage to the frame 12 of the ATV 10.

As will be appreciated from FIGS. 21 and 22, in use, the plow 50 exerts a force on the cylindrical portion 124 of the pin 104 which generates a bending moment about a pivot center of the pin 104 (disposed near the proximal end recess 141). The fasteners 106' exert a force on the pin 104 to pull the peripheral surface 134 of the non-cylindrical portion 126 into contact with the peripheral surface 218 of the recess 216. This in turn positions the protrusion 121 within the adapter recess 141. The bending moment exerted on the pin 102 is countered by the fasteners 106' as well as by the engagement of the protrusion 121 within the proximal end recess 141 such as to prevent the pin 104 from rotating under the force of the plow 50 with respect to the adapter 102. The size and shape of the fasteners 106' could be adapted to create a second weak point in the system so that the fasteners 106' will shear before any damage to the frame 12 is done.

Figure 23:
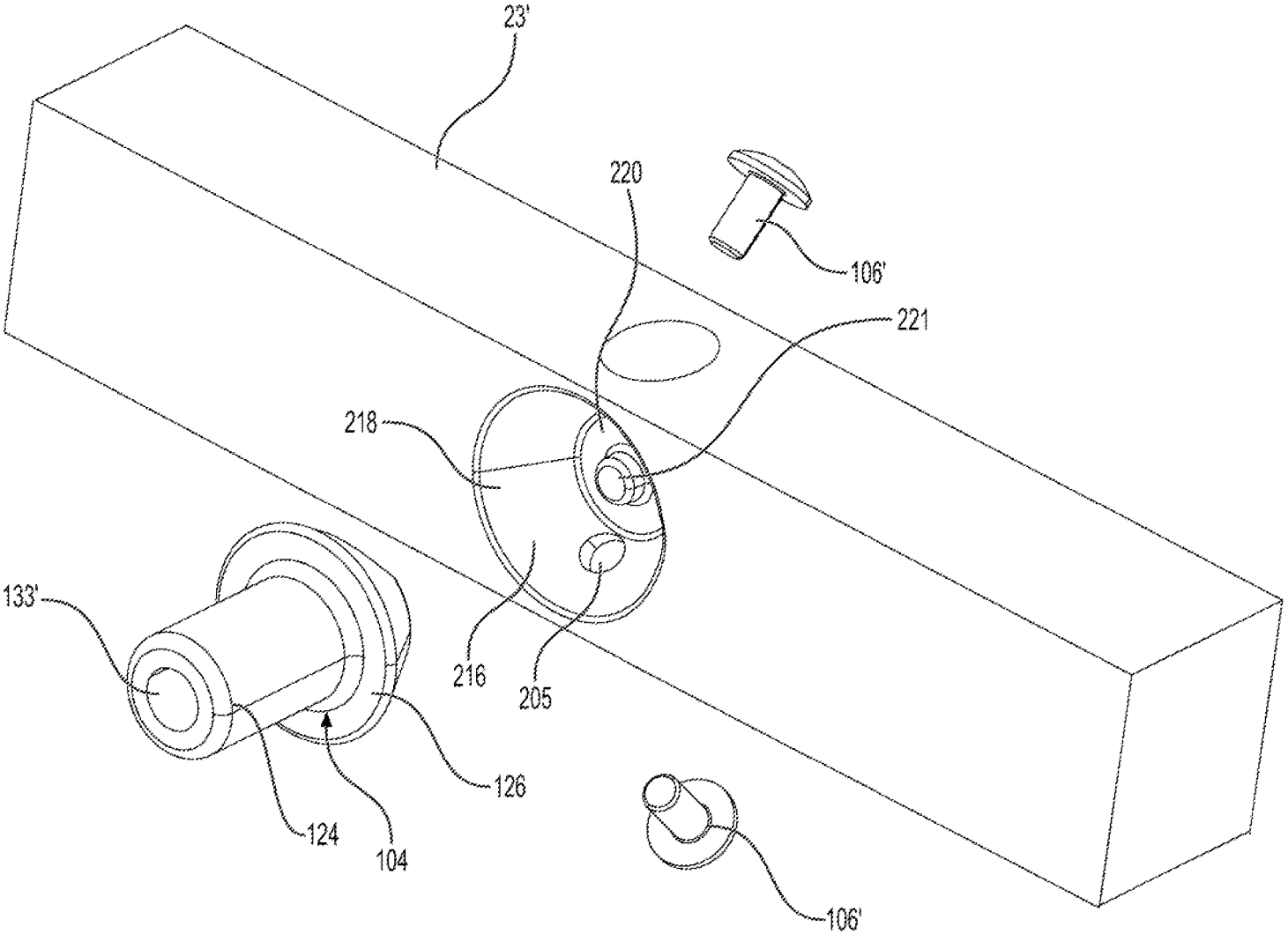
FIG. 23 is a perspective view, taken from a rear, left side, of the longitudinally-extending member of the frame and the plow connection system of FIG. 18 in accordance with a variant, showing the plow connection system in an exploded configuration.

Moreover, in a variant illustrated in FIG. 23, as described above for another embodiment, the adapter 102 may be omitted and the generally non-cylindrical portion 126 of the pin 104 is instead received in the recess 216 of the longitudinally-extending member 23' of the frame 12. As can be seen, in this alternative embodiment, the inner peripheral surface 218 of the recess 216 has a shape matching the generally truncated conical shape of the non-cylindrical portion 126 of the pin 104. The recess bottom 220 has a protrusion 221 to be received in the recess 141 of the pin 104. Furthermore, the longitudinally-extending member 23' defines two openings 205 opening into the recess 216 and configured to receive the fasteners 106'.

It is contemplated that, in some embodiments, a weak point may be provided on the pin 104 (e.g., a notch) to ensure that, upon the ATV 10 being subjected to a heavy impact, the pin 104 fails rather than the frame 12 of the ATV 10 being damaged.

Figure 27:
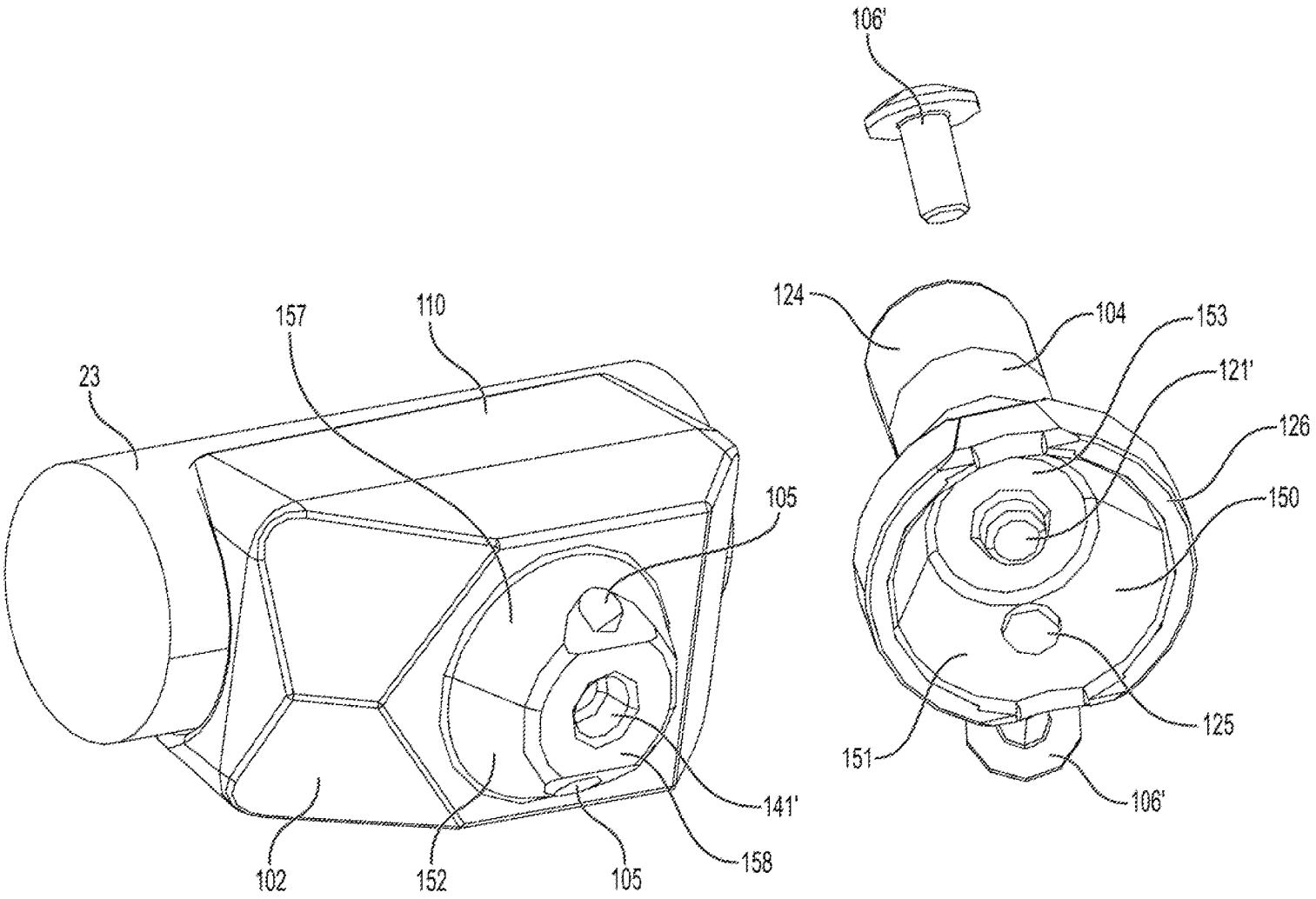
FIG. 27 is an exploded perspective view of a left adapter and pin of the plow connection system in accordance with another embodiment.
Figure 28:
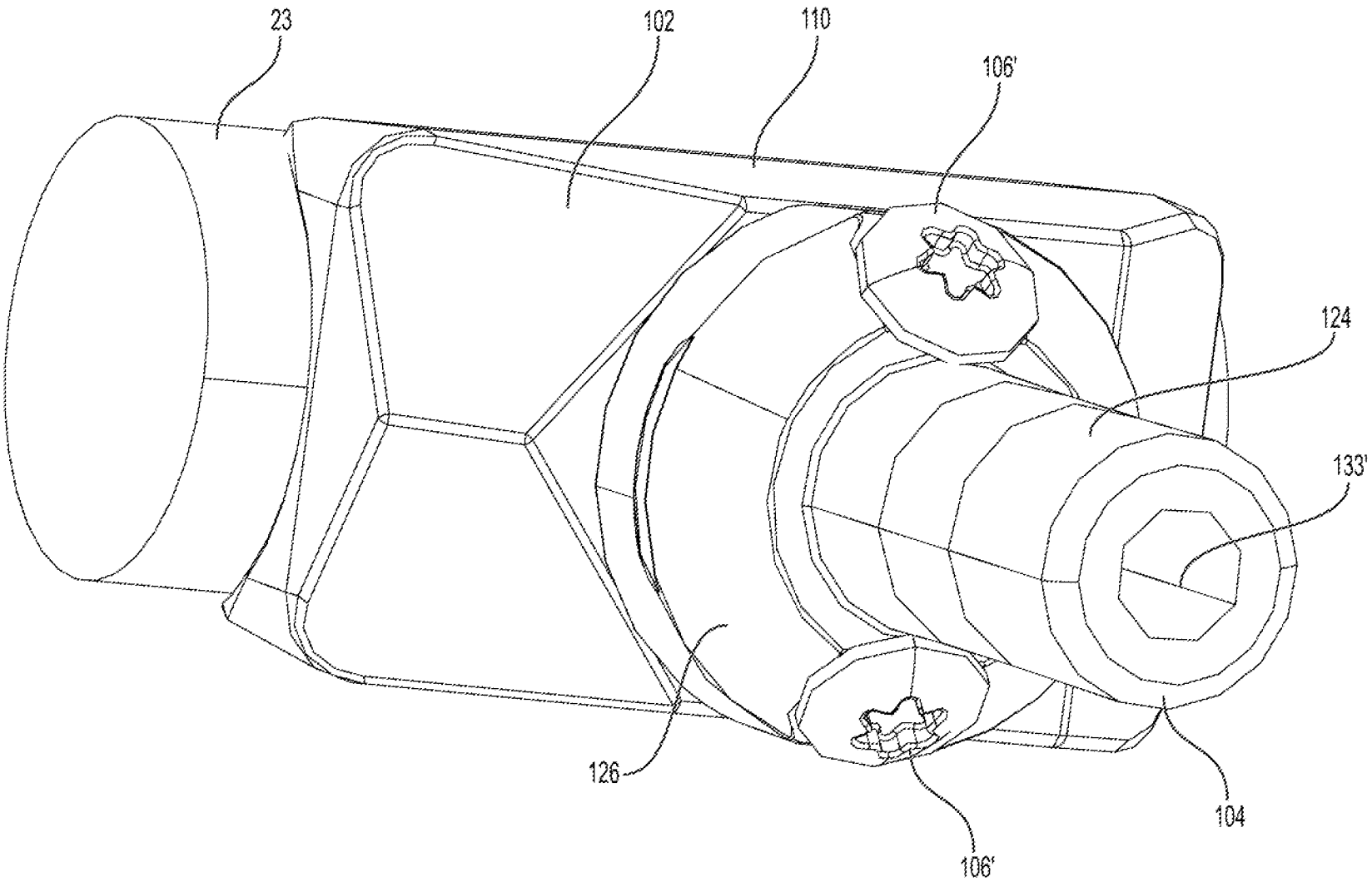
FIG. 28 is a perspective view, taken from a front, left side, of the longitudinally-extending member of the frame and the plow connection system of FIG. 27 in an assembled configuration.

Another alternative embodiment of the implement connection system 100 is shown in FIGS. 27 and 28. In this alternative embodiment, the adapter 102 is connected to the corresponding longitudinally-extending member 23 by an inwardly-extending protrusion (not shown) similar to the protrusion 165 discussed above. In this alternative embodiment, the adapter 102 does not define a recess for receiving the non-cylindrical portion 126 of the pin 104. Rather, the adapter 102 has a protruding portion 152 which protrudes laterally outwardly from the outer surface 110 of the adapter 102. In this embodiment, the protruding portion 152 has a generally truncated conical shape and has an outer peripheral surface 157 and a transverse surface 158. The outer peripheral surface 157 of the protruding portion 152 defines two openings 105 for receiving respective fasteners 106'. In this embodiment, the openings 105 are on opposite sides of the protruding portion 152 and are threaded to threadedly engage the fasteners 106'. The transverse surface 158 of the protruding portion 152 defines an adapter recess 141'.

As shown in FIG. 27, in this alternative embodiment, the non-cylindrical portion 126 of the pin 104 defines a recess 150 that is configured to receive the protruding portion 152 of the adapter 102 therein. Notably, the recess 150, which is defined by an inner peripheral surface 151 and a recess bottom 153, has a matching shape to that of the protruding portion 152. In particular, the inner peripheral surface 151 is generally conical so as to receive the generally truncated conical shape of the protruding portion 152. The peripheral surface 151 also defines two openings 125 (one of which is shown in FIG. 27) for receiving the fasteners 106'. A protrusion 121' protrudes from the recess bottom 153 and is received in the adapter recess 141' defined by the transverse surface 158. The adapter recess 141' and the protrusion 121' are coaxial with the central axis of the pin 104. Receiving the protrusion 121' within the adapter recess 141' limits movement of the pin 104 relative to the adapter 102, particularly decreasing bending moments about the pin 104. The protrusion 121' may thus be referred to as a "movement limiting feature". The protrusion 121' thus supports the pin 104, notably being subject to loads that are exerted on the pin 104.

As shown in FIG. 28, in this alternative embodiment, once the pin 104 is engaged with the adapter 102, namely by receiving the protruding portion 152 thereof into the recess 150, the fasteners 106' are inserted through the openings 125 and threadedly engage the openings 105 of the adapter 102.

As will be appreciated from the above-described embodiments, installation of the pin 104 onto the frame 12 via the adapter 102 and the fastener 106 (or fasteners 106') is relatively simple. Notably, in addition to requiring few parts for the installation of the pin 104 onto the frame 12 which in itself reduces the weight of ATV 10 in comparison to conventional plow connection systems, the installation of the pin 104 can be done without having to gain access to an underside of the ATV 10 as installing conventional plow mounting brackets often requires. Rather, the installation of the pin 104 can be done simply via the lateral sides of the ATV 10. Similarly, once the pin 104 is in place, the plow 50 and the plow connectors 70 can also be connected to the pins 104 via the lateral sides of the ATV 10 rather than by accessing the underside of the ATV 10.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. An implement connection system for connecting an implement to a vehicle, the implement connection system comprising:

a pin having:

a distal portion defining a distal end of the pin, the distal portion being adapted to be received by an implement connector; and a proximal portion defining a proximal end of the pin, the proximal portion being a non-cylindrical portion that tapers toward the proximal end; and a fastener configured to extend into the pin and towards a portion of the vehicle to removably fasten the pin to the portion of the vehicle, the proximal end being disposed between the distal end and the portion of the vehicle when the pin is fastened to the portion of the vehicle, the non-cylindrical portion of the pin being adapted for one of:

insertion into a non-cylindrical recess of a frame of the vehicle, the non-cylindrical recess being complementary in shape to the non-cylindrical portion of the pin, and being received by an adapter configured to be connected to a frame of the vehicle.

2. The implement connection system of claim 1, wherein:

the pin has a central opening defined therein; and a distal end of the fastener is disposed in the central opening below a surface of the pin in a longitudinal direction of the fastener.

3. The implement connection system of claim 1, wherein:

the non-cylindrical portion has a generally truncated conical shape; and a maximum diameter of the truncated conical shape of the non-cylindrical portion is greater than a diameter of the distal portion.

4. The implement connection system of claim 1, wherein:

the non-cylindrical portion has a transverse surface that is normal to a central axis of the pin; and the non-cylindrical portion defines a movement limiting feature for at least partly limiting movement of the pin relative to the portion of the vehicle, the movement limiting feature being one of:

a recess defined in the transverse surface; and a protrusion extending from the transverse surface.

5. The implement connection system of claim 1, wherein the fastener extends along a fastener axis, the fastener axis extending at an angle relative to a central axis of the pin.

6. The implement connection system of claim 1, further comprising an adapter receiving the non-cylindrical portion of the pin, the adapter being configured to be connected to a frame of the vehicle, wherein:

the adapter comprises:

a plurality of inner surfaces defining a recess having a shape corresponding to a shape of the non-cylindrical portion of the pin, the plurality of inner surfaces of the adapter being configured to mate with the non-cylindrical portion of the pin; and a protrusion extending from one of the plurality of inner surfaces of the adapter and into the non-cylindrical portion of the pin to limit movement of the pin relative to the adapter.

7. The implement connection system of claim 6, wherein the protrusion is aligned with a central axis of the pin.

8. The implement connection system of claim 1, wherein the fastener extends generally along a longitudinal direction defined by the pin.

9. The implement connection system of claim 1, wherein the non-cylindrical portion has a generally asymmetric shape.

10. The implement connection system of claim 1, wherein:

the non-cylindrical portion has a transverse surface that is normal to a central axis of the pin; and the non-cylindrical portion defines a pin orientation feature for orienting the pin on the portion of the vehicle, the pin orientation feature being one of:

a recess defined in the transverse surface; and a protrusion extending from the transverse surface.

11. The implement connection system of claim 1, wherein the non-cylindrical portion of the pin is adapted to be inserted in the non-cylindrical recess of the vehicle.

12. The implement connection system of claim 1, further comprising the adapter for receiving the non-cylindrical portion of the pin.

13. The implement connection system of claim 12, wherein the adapter comprises a plurality of inner surfaces defining a recess having a shape corresponding to a shape of the non-cylindrical portion of the pin, the plurality of inner surfaces of the adapter being configured to mate with the non-cylindrical portion of the pin.

14. The implement connection system of claim 1, wherein the distal portion of the pin is a cylindrical portion.

15. An implement connection system for connecting an implement to a vehicle, the implement connection system comprising:

a pin having:

a distal portion defining a distal end of the pin, the distal portion being adapted to be received by an implement connector; and a proximal portion defining a proximal end of the pin; and a fastener extending into the pin for removably fastening the pin to a portion of the vehicle, the proximal end being disposed between the distal end and the portion of the vehicle when the pin is fastened to the portion of the vehicle, the distal portion of the pin is generally cylindrical and has a central opening extending along a majority of a length of the distal portion in order for the distal portion to fail under excessive mechanical stress to protect the portion of the vehicle.

16. A plow assembly comprising:

the implement connection system of claim 1, wherein:

the pin is a first pin;

the fastener is a first fastener;

the portion of the vehicle is a first portion of the vehicle;

the implement connection system further comprises:

a second pin coaxial with the first pin, the second pin having:

a distal portion defining a distal end of the second pin, the distal portion of the second pin being adapted to be received by another implement connector; and a proximal portion defining a proximal end of the second pin; and a second fastener extending into the second pin for removably fastening the second pin to a second portion of the vehicle, the proximal end of the second pin being disposed between the distal end of the second pin and the second portion of the vehicle when the second pin is fastened to the second portion of the vehicle, the implement connection system being a plow connection system for connecting a plow to the vehicle; and a plow connected to the plow connection system, the plow comprising:

first and second support arms; and first and second implement connectors connected to the first and second support arms respectively, the first and second implement connectors being supported by the distal portion of the first pin and the distal portion of the second pin respectively.

17. The plow assembly of claim 16, wherein each of the first and second implement connectors has a hooked end engaging the distal portion of a corresponding one of the first and second pins.

18. A plow assembly comprising:

a plow connection system comprising:

a first pin having:

a distal portion defining a distal end of the first pin, the distal portion being adapted to be received by an implement connector; and a proximal portion defining a proximal end of the first pin; and a first fastener extending into the first pin for removably fastening the first pin to a first portion of a vehicle, the proximal end being disposed between the distal end and the first portion of the vehicle when the first pin is fastened to the first portion of the vehicle;

a second pin coaxial with the first pin, the second pin having:

a distal portion defining a distal end of the second pin, the distal portion of the second pin being adapted to be received by another implement connector; and a proximal portion defining a proximal end of the second pin;

a second fastener extending into the second pin for removably fastening the second pin to a second portion of the vehicle, the proximal end of the second pin being disposed between the distal end of the second pin and the second portion of the vehicle when the second pin is fastened to the second portion of the vehicle; and a plow connected to the plow connection system, the plow comprising:

first and second support arms;

first and second implement connectors connected to the first and second support arms respectively, the first and second implement connectors being supported by the distal portion of the first pin and the distal portion of the second pin respectively; and first and second bumpers for limiting movement of the first and second pins relative to the plow and to prevent damage to the first and second pins, the first and second bumpers being connected to the first and second support arms respectively and positioned to abut the first and second pins in response to the first and second pins moving forward relative to the plow.

19. The plow assembly of claim 18, wherein the first and second bumpers are made of a polymeric material.

* * * * *